US006423487B2

(12) United States Patent
Naoi

(10) Patent No.: US 6,423,487 B2
(45) Date of Patent: Jul. 23, 2002

(54) THERMALLY PROCESSED IMAGE RECORDING MATERIAL

(75) Inventor: Takashi Naoi, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/833,575

(22) Filed: Apr. 13, 2001

(30) Foreign Application Priority Data

Apr. 13, 2000 (JP) ..... 2000-111576
Apr. 13, 2000 (JP) ..... 2000-111975

(51) Int. Cl.[7] ..... G03C 1/498; G03C 1/30

(52) U.S. Cl. ..... 430/619; 430/523; 430/531; 430/618; 430/622; 430/623; 430/630; 430/631; 430/635

(58) Field of Search ..... 430/523, 531, 430/618, 619, 622, 627, 631, 623, 630, 635

(56) References Cited

U.S. PATENT DOCUMENTS 5,124,376 A * 6/1992 Clark, Jr. ..... 523/336
5,405,741 A * 4/1995 Conroy et al. ..... 430/628
5,972,591 A * 10/1999 Yarmey et al. ..... 430/631
6,140,038 A * 10/2000 Ishizuka et al. ..... 430/619

OTHER PUBLICATIONS

You Han Bae et al.; Makromol. Chem., Rapid Commun. 8, pp. 481–485 (1987).

* cited by examiner

*Primary Examiner*—Thorl Chea
(74) *Attorney, Agent, or Firm*—Birch, Stewart, Kolasch & Birch, LLP

(57) ABSTRACT

The present invention provides a thermally processed image recording material having, on a support, an image-forming layer containing at least (a) a silver salt of an organic acid, (b) a reducing agent and (c) a photosensitive silver halide and at least one protective layer provided on the image-forming layer and comprising polymer latex as binders of the image-forming layer and the protective layer, wherein at least one of the image-forming layer and the protective layer contains a viscosity enhancer that increases viscosity of its aqueous solution when the solution is heated and temperature of the solution exceeds a certain transition temperature, and the viscosity enhancer is a polymer selected from the group consisting of polymers containing a (meth)acrylamide derivative represented by the following formula (1) or (2) in an amount of 50 weight % or more as constituent units:

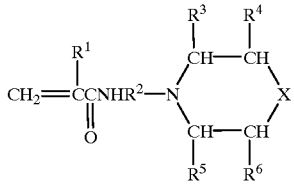

(wherein $R^1$ represents H or $CH_3$, $R^2$ represents an alkylene group, $R^3$ to $R^6$ represent H or $CH_3$, and X represents —O—, —S—, —NH—, —N($R^7$)— where $R^7$ represents an alkyl group, —$CH_2$— or a direct bond),

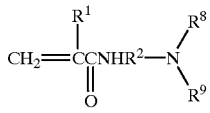

(wherein $R^8$ and $R^9$ represent H or an alkyl group), and aqueous vinyl polymers containing a vinyl carboxylic acid esters of alkylene oxide adduct of active hydrogen compound having a nitrogen-containing ring in an amount of 50% or more as constituent units.

20 Claims, No Drawings

THERMALLY PROCESSED IMAGE RECORDING MATERIAL

TECHNICAL FIELD

The present invention relates to a thermally processed image recording material. In particular, the present invention relates to a thermally processed image recording material for scanners, image setters and so forth, which is particularly suitable for photographic art. More precisely, the present invention relates to a thermally processed image recording material that is free from "wrinkles (swelling)" and "cracks (cracking)" on the surface of the thermally processed image recording material, shows superior adhesion between images and support, and is suitable for color photographic art.

RELATED ART

As one of light exposure methods for photographic materials, there is known the so-called scanner type image-forming method, in which an original is scanned and light exposure is performed on a silver halide photographic material based on the obtained image signals to form a negative or positive image corresponding to an image of the original.

Further, there are desired photosensitive materials for scanners having ultrahigh contrast characteristics for cases in which images are directly printed on printing plates without reversing process after the signals are output from scanners onto films or for light sources of scanners having a soft beam profile.

There are known many photosensitive materials having a photosensitive layer on a support, with which image formation is attained by imagewise light exposure. These materials include those utilizing a technique of forming images by heat development as systems that can contribute to the environmental protection and simplify image-forming means.

In recent years, reduction of amount of waste processing solutions is strongly desired in the field of photographic art from the standpoints of environmental protection and space savings. Therefore, development of techniques relating to thermally processed image recording materials for photographic art is required, which materials enable efficient exposure by a laser scanner or laser image setter and formation of clear black images having high resolution and sharpness. Such thermally processed image recording materials can provide users with simpler and non-polluting heat development processing systems that eliminate the use of solution-type processing chemicals.

Methods for forming images by heat development are described in, for example, U.S. Pat. Nos. 3,152,904 and 3,457,075 and D. Klosterboer, "Thermally Processed Silver Systems A", Imaging Processes and Materials, Neblette, 8th ed. compiled by J. Sturge, V. Walworth and A. Shepp, Chapter 9, p.279, (1989). Such thermally processed image recording materials comprise a reducible non-photosensitive silver source (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas shows black color and provides contrast with respect to the non-exposed areas, and thus images are formed.

In many of conventionally known photothermographic materials, image-forming layers are formed by coating a coating solution using an organic solvent such as toluene, methyl ethyl ketone (MEK) and methanol as a solvent. However, not only use of an organic solvent as a solvent adversely affect human bodies during the production process, but also it is disadvantageous in view of cost because it requires process steps for recovery of the solvent and so forth.

Accordingly, methods of forming an image-forming layer by coating a coating solution using water as a solvent have been proposed. For example, Japanese Patent Laid-open Publication (Kokai, hereinafter referred to as JP-A) 49-52626, JP-A-53-116144 and so forth disclose image-forming layers utilizing gelatin as a binder, and JP-A-50-151138 discloses an image-forming layer utilizing polyvinyl alcohol as a binder. Furthermore, JP-A-60-61747 discloses an image-forming layer utilizing gelatin and polyvinyl alcohol in combination. As another example, JP-A-58-28737 discloses an image-forming layer utilizing a water-soluble polyvinyl acetal as a binder. If these binders are used, image-forming layers can be formed by using a coating solution comprising an aqueous solvent, and therefore considerable merits can be obtained with respect to environment and cost.

However, when a polymer such as gelatin, polyvinyl alcohol or water-soluble polyacetal is used as a binder, there is caused a problem that dehydration shrinkage of the binder and thermal expansion of the support simultaneously occur and thus wrinkles are generated on the film. Therefore, there can be obtained only films unsuitable for color printing, in which films are stacked in their use.

As methods for preventing the generation of wrinkles during heat development, techniques utilizing polymer latex as the binder are disclosed in JP-A-11-84573, JP-A-11-295845, Japanese Patent Application Nos. 11-91359, 11-143058, 11-187243 and so forth. These methods are superior methods for preventing the generation of wrinkles.

Coating solutions containing polymer latex as a binder are forcibly dried by heating after coating. However, coating solutions utilizing polymer latex, which is an aqueous dispersion of hydrophilic polymer, as a binder essentially involve a serious problem that they are likely to form films at surfaces of coated layers in the drying process after the coating and thus drying of internal portion becomes difficult to advance. If the drying temperature is elevated or volume of drying air is increased in order to advance the drying, "swelling" or "cracking" may be caused in the films. To prevent the "swelling" or "cracking", coating must be performed with a reduced drying speed by lowering the drying temperature or decreasing the drying air volume. Therefore, in this field, it is an extremely important object to increase the speed to increase productivity and reduce energy cost.

Accordingly, an object of the present invention is to provide a thermally processed image recording material that can prevent the film formation at the surface, hence causes no "swelling" or "cracking", during the drying by heating after coating of coating solution and shows superior adhesion between images and support.

DISCLOSURE OF THE INVENTION

The inventors of the present invention assiduously studied in order to achieve the aforementioned object. As a result;

they found that the film formation phenomenon could be inhibited and hence superior thermally processed image recording materials that showed desired effects could be provided by thickening and gelling coating solutions through dry heating, and thus accomplished the present invention.

That is, the present invention provides a thermally processed image recording material having, on a support, an image-forming layer containing at least (a) a silver salt of an organic acid, (b) a reducing agent and (c) a photosensitive silver halide and at least one protective layer provided on the image-forming layer and comprising polymer latex as binders of the image-forming layer and the protective layer, wherein at least one of the image-forming layer and the protective layer contains a viscosity enhancer that increases viscosity of its aqueous solution when the solution is heated and temperature of the solution exceeds a certain transition temperature, and the viscosity enhancer is a polymer selected from the group consisting of polymers containing a (meth)acrylamide derivative represented by the following formula (1) or (2) in an amount of 50 weight % or more as constituent units:

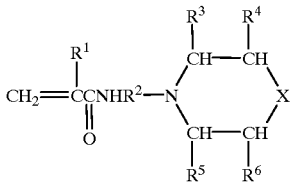

(in the formula (1), $R^1$ represents hydrogen atom or methyl group, $R^2$ represents an alkylene group having 1–6 carbon atoms, $R^3$ to $R^6$ each independently represent hydrogen atom or methyl group, and X represents —O—, —S—, —NH—, —N($R^7$)— where $R^7$ represents an alkyl group having 1–4 carbon atoms, —$CH_2$— or a direct bond),

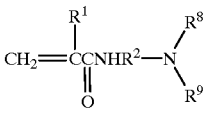

(in the formula (2), $R^1$ and $R^2$ have the same meanings as defined in the formula (1), and $R^8$ and $R^9$ each independently represent hydrogen atom or an alkyl group having 1–6 carbon atoms provided that the sum of the carbon numbers of $R^8$ and $R^9$ is 3 or more), and aqueous vinyl polymers containing a vinyl carboxylic acid esters of alkylene oxide adduct of active hydrogen compound having a nitrogen-containing ring in an amount of 50 weight % or more as constituent units.

In preferred embodiments of the thermally processed image recording material of the present invention, for example, the aforementioned (meth)acrylamide derivative is N-morpholinoethyl(meth)acrylamide or N-(4-methylpiperazinoethyl)(meth)-acrylamide; sum of carbon numbers of $R^8$ and $R^9$ in the aforementioned formula (2) is 5–8; the (meth)acrylamide derivative represented by the formula (2) is N-(N'-ethyl-N'-isopropylaminoethyl)(meth) acrylamide or N(N'-ethyl-N'-dipropylaminoethyl)(meth) acrylamide; the viscosity enhancer is a polymer containing the (meth)acrylamide derivative represented by the formula (1) or (2) in an amount of 70 weight % or more as constituent units; the polymers containing the (meth)acrylamide derivative represented by the formula (1) or (2) has a weight average molecular weight of 1,000–5,000,000, preferably 10,000–2,000,000, further preferably 10,000–1,000,000; the nitrogen-containing ring of the aqueous vinyl polymer is piperidine ring or morpholine ring; the alkylene oxide of the aqueous vinyl polymer is ethylene oxide and/or propylene oxide; molar number of the added alkylene oxide in the aqueous vinyl polymer is 1–50 moles per mole of the active hydrogen compound; the molar number of the added alkylene oxide in the aqueous vinyl polymer is 1–5 moles per mole of the active hydrogen compound; the vinyl carboxylic acid in the aqueous vinyl polymer is (meth)acrylic acid; the vinyl carboxylic acid ester in the aqueous vinyl polymer is an (meth)acrylic ester of 1–20 mole ethylene oxide and/or propylene oxide adduct of substituted or unsubstituted morpholine; the aqueous vinyl polymer contains the vinyl carboxylic acid ester of the alkylene oxide adduct of active hydrogen compound having a nitrogen-containing ring in an amount of 70 weight % or more as constituent units; the aqueous vinyl polymer has a molecular weight of 10,000–2,000,000, preferably 10,000–1,000,000, the binder of the image-forming layer is styrene/butadiene type latex, acryl type latex or styrene/acryl type latex; the binder of the image-forming layer has a glass transition temperature of —30–80° C.; and the binder of the protective layer has a glass transition temperature of 25–80° C.

DETAILED EXPLANATION OF THE INVENTION

Embodiments of the thermally processed image recording material of the present invention and methods for practicing it will be explained in detail hereafter. In the present specification, ranges indicated with "-" mean ranges including the numerical values before and after "-" as the minimum and maximum values.

The thermally processed image recording material of the present invention has, on a support, an image-forming layer containing at least (a) a silver salt of an organic acid, (b) a reducing agent and (c) a photosensitive silver halide and at least one protective layer provided on the image-forming layer, and comprises polymer latex as binders of the image-forming layer and the protective layer, and it is characterized in that at least one of the image-forming layer and the protective layer contains a viscosity enhancer that increases viscosity of its aqueous solution when the solution is heated and temperature of the solution exceeds a certain transition temperature, and the viscosity enhancer is a polymer selected from the group consisting of polymers containing 50 weight % or more of a (meth)acrylamide derivative represented by the aforementioned formula (1) or (2) as constituent units (referred to as Polymer A) and aqueous vinyl polymers containing 50% or more of vinyl carboxylic acid ester of alkylene oxide adduct of active hydrogen compound having a nitrogen-containing ring (referred to as Polymer B) as constituent units.

Specific examples of the (meth)acrylamide derivative represented by the aforementioned formula (1), which is a constituent of Polymer A as the viscosity enhancer used for the present invention, include those having (thio)morpholine ring [N-morpholinoethyl(meth)acrylacrylamide, N-morpholinopropyl(meth)acrylamide, N-morpholinobutyl (meth)acrylamide, N-(3-methylmorpholino-4-ethyl)(meth) acrylacrylamide, N-(2,6-dimethylmorpholino-4-ethyl) (meth)acrylamide, N-thiomorpholinoethyl(meth) acrylamide, N-thiomorpholinopropyl(meth)acrylamide etc.], those having a piperidine ring [N-piperidinoethyl (meth)acrylamide, N-(2-methylpiperidinoethyl)(meth) acrylamide, N-(3,5-dimethylpiperidinoethyl)(meth)

acrylamide etc.], those having a pyrrolidine ring [N-pyrrolidinoethyl(meth)acrylamide, N-pyrrolidinopropyl (meth)acrylamide etc.], those having a piperazine ring [N-piperazino-ethyl(meth)acrylamide, N-piperazinopropyl (meth)acrylamide, N-piperazinobutyl(meth)acrylamide, N-piperazinopentyl(meth)acrylamide, N-piperazinohexyl (meth)acrylamide, N-(4-methylpiperazinoethyl)(meth) acrylamide, N-(4-ethylpiperazinoethyl)(meth)acrylamide, N-(4-propylpiperazinoethyl)(meth)acrylamide, N-(4-butylpiperazinoethyl)(meth)acrylamide etc.,] and so forth.

Among these, N-morpholinoethyl(meth)acrylamide and N-(4-methylpiperazinoethyl)(meth)acrylamide are particularly preferred, since they show more sharp thermal viscosity enhancing property.

In the (meth)acrylamide derivative represented by the aforementioned formula (2), which is a constituent of Polymer A as the viscosity enhancer used for the present invention( the sum of the carbon numbers of $R^8$ and $R^9$ is 3 or more, preferably 5–8. Those having a sum of the carbon numbers of $R^8$ and $R^9$ lower than 3 do not provide sufficient thermal viscosity enhancing property.

Specific examples of the (meth)acrylamide derivative represented by the formula (2) include N-(propylaminoethyl)(meth)acrylamide, N-(propylaminopropyl)(meth)acrylamide, N-(propylaminobutyl)(meth)acrylamide, N-(propylaminopentyl)(meth)acrylamide, N-(propylaminohexyl)(meth)acrylamide, N-(butylaminoethyl)(meth)acrylamide, N-(hexylaminoethyl)(meth)acrylamide, N-(isobutylaminoethyl)(meth)acrylamide, N-(N'-methyl-N'-propylaminoethyl)(meth)acrylamide, N-(N'-methyl-N'-butylaminoethyl)(meth)acrylamide, N-(N'-ethyl-N'-isopropylaminoethyl)(meth)acrylamide, N-(N',N'-dipropylaminoethyl)(meth)acrylamide, N-(N',N'-dibutylaminoethyl)(meth)acrylamide, N-(N',N'-dihexylaminoethyl) (meth)acrylamide and so forth.

Among these, N-(N'-ethyl-N'-isopropylaminoethyl) (meth)acrylamide and N-(N'-ethyl-N'-dipropylaminoethyl) (meth)acrylamide are particularly preferred, since they show more sharp thermal viscosity enhancing property.

Polymer A used in the present invention as the viscosity enhancer contains 50 weight % or more, preferably 70 weight % or more, of the (meth)acrylamide derivative represented by the aforementioned formula (1) or (2) as constituent units. Polymer A may consist of a (copolymer of one ore more kinds of the (meth)acrylamide derivatives represented by the aforementioned formula (1) or (2), or a copolymer of one ore more kinds of the (meth)acrylamide derivatives represented by the aforementioned formula (1) or (2) and one or more kinds of other vinyl monomers.

Polymer A used in the present invention as the viscosity enhancer can be obtained by (co)polymerizing one ore more kinds of the (meth)acrylamide derivatives represented by the aforementioned formula (1) or (2), or one ore more kinds of the (meth)acrylamide derivatives and one or more kinds of other vinyl monomers according to a known method (block polymerization, solution polymerization, emulsion polymerization, suspension polymerization etc.).

Polymer A used in the present invention as the viscosity enhancer usually has a weight average molecular weight of 1,000–5,000,000, preferably 10,000–2,000,000, particularly preferably 10,000–1,000,000.

The active hydrogen compound having a nitrogen-containing ring, which is a constituent of Polymer B used in the present invention as the viscosity enhancer, is a compound having a nitrogen-containing ring and an active hydrogen for addition of alkylene oxide. Examples thereof include, for example, nitrogen-containing alicyclic compounds [those having an aziridine ring (aziridine, 2-methylaziridine etc.), those having a pyrrolidine ring (pyrrolidine, 2-methylpyrrolidine, 2-pyrrolidone, succinimide etc.), those having a piperidine ring (piperidine, 2-methylpiperidine, 3,5-dimethylpiperidine, 2-ethylpiperidine, 4-piperidinopiperidine, 4-pyrrolidinopiperidine, ethyl pipecolinate etc.), those having a piperazine ring (1-methylpiperazine, 1-methyl-3-ethylpiperazine etc.), those having a morpholine ring (morpholine, 2-methylmorpholine, 3,5-dimethylmorpholine, thiomorpholine etc.), ϵ-caprolactam and so forth], nitrogen-containing unsaturated cyclic compounds (3-pyrroline, 2,5-dimethyl-3-pyrroline, 2-hydroxypyridine, 4-pyridylcarbinol, 2-hydroxypyrimidine etc.) and so forth.

Among these, nitrogen-containing alicyclic compounds are preferred, those having a piperidine ring or a morpholine ring are more preferred, and those having a morpholine ring are further preferred.

Examples of the alkylene oxide to be added to the active hydrogen compound having a nitrogen-containing ring include ethylene oxide, propylene oxide, butylene oxide and so forth, and these may be used each alone or as a combination of two or more kinds of them. Among these, ethylene oxide and/or propylene oxide are preferably used.

The viscosity enhancer containing Polymer B enhances viscosity when it is heated and its temperature exceeds a certain transition temperature. This transition temperature can be easily controlled by changing kind and addition number of the alkylene oxide. When ethylene oxide is used as the alkylene oxide, a larger molar number of added ethylene oxide provides a higher transition temperature. When propylene oxide or butylene oxide is used as the alkylene oxide, a larger molar number of added alkylene oxide provides a lower transition temperature. Although the molar number of alkylene oxide to be added varies depending on desired transition temperature, kind of the active hydrogen compound having a nitrogen-containing ring, kind of the alkylene oxide and so forth, it is usually 1–50 moles, preferably 1–5 moles, The vinyl carboxylic acid, which is a constituent of the aqueous vinyl polymer as the viscosity enhancer containing Polymer B, is not particularly limited so long as it is a compound that reacts with the aforementioned alkylene oxide adduct to form a vinyl carboxylic acid ester, and examples thereof include vinyl carboxylic acids [(meth) acrylic acid, (iso)crotonic acid, maleic acid, fumaric acid, itaconic acid, vinylbenzoic acid etc.], derivatives that form esters of these vinyl carboxylic acids (anhydrides, acid halides, methyl esters etc.) and so forth. Among these, (meth)acrylic acid, maleic acid, vinylbenzoic acid and derivatives that form esters of these vinyl carboxylic acids are preferred, and (meth)acrylic acid and derivatives that form esters of (meth)acrylic acid are more preferred.

Polymer B is a polymer of an ester of the aforementioned alkylene oxide adduct and the vinyl carboxylic acid, and contains 50 weight % or more of the vinyl carboxylic acid ester as constituent units. Polymer B maybe a (co)polymer of one or more kinds of the aforementioned vinyl carboxylic acid esters, or may be a copolymer of one or more kinds of the aforementioned vinyl carboxylic acid esters and one or more kinds of other vinyl monomers.

The other vinyl monomers that can be copolymerized with the aforementioned vinyl carboxylic acid esters are not particularly limited so long as they are polymerizable vinyl monomers, and examples thereof include, for example, hydrophilic vinyl monomers, ionic vinyl monomer and lipophilic vinyl monomers other than the aforementioned vinyl carboxylic acid esters.

Examples of the hydrophilic vinyl monomers other than the aforementioned vinyl carboxylic acid esters include, for example, hydroxyethyl (meth)acrylate, polyethylene glycol mono(meth)acrylate, (meth)acrylamide, N-methylol (meth) acrylamide, N-vinyl-2-pyrrolidone and so forth.

Examples of the ionic vinyl monomers include, for example, acids such as (meth)acrylic acid, maleic acid (anhydride) and styrenesulfonic acid and salts thereof, amines such as N,N-dimethylaminoethyl(meth)acrylate and N,N-diethylaminopropyl (meth)acrylate and salts thereof and so forth.

Examples of the lipophilic vinyl monomers include, for example, (meth)acrylate derivatives such as methyl (meth) acrylate, butyl(meth)acrylate and glycidyl(meth)acrylate, N-alkyl(meth)acrylamide derivatives such as N-butyl(meth) acrylamide and N-cyclohexyl(meth)acrylamide, (meth) acrylonitrile, styrene, vinyl acetate, vinyl chloride, butadiene, isoprene and so forth.

When the aforementioned vinyl carboxylic acid esters are copolymerized with other vinyl monomers, the other vinyl monomers are preferably hydrophilic vinyl monomers other than the aforementioned vinyl carboxylic acid esters.

Polymer B contains the aforementioned vinyl carboxylic acid esters in a constitutive ratio of 50 weight % or more, preferably 70 weight % or more. If the aqueous vinyl polymer consists only of the vinyl carboxylic acid ester, viscosity of an aqueous solution (coating solution) added with the vinyl carboxylic acid ester is enhanced within a very narrow temperature range when its temperature exceeds the transition temperature and the solution gels. However, if it contains the vinyl carboxylic acid ester at a low ratio, viscosity of such a solution is enhanced over a wide temperature range with increase of temperature.

Polymer B usually has a weight average molecular weight of 1,000–5,000,000, preferably 10,000–2,000,000, particularly preferably 10,000–1,000,000.

The form of the viscosity enhancer used for the present invention is not particularly limited, and it may be a dried and pulverized solid material consisting of Polymer A or B or a solution containing Polymer A or B at an arbitrary concentration. When it is used as a solution, water, acetone, methanol, isopropyl alcohol and so forth may be used as a solvent.

The viscosity enhancer used for the present invention has a transition temperature at which it reversibly enhances viscosity of its aqueous solution by heating. The transition temperature of the viscosity enhancer containing Polymer A varies depending on hydrophilicity of Polymer A. That is, higher hydrophilicity provides a higher transition temperature, and lower hydrophilicity provides a lower transition temperature. A viscosity enhancer containing Polymer A is used by mixing it with an aqueous solution at a temperature lower than the transition temperature of the viscosity enhancer, and elevating the temperature. A viscosity enhancer containing Polymer B is used by mixing it with an aqueous solution at a temperature higher than the transition temperature of the viscosity enhancer. The transition temperature varies depending on kinds of salt, surfactant, solvent and so forth in the aqueous solution.

Although the amount of the viscosity enhancer used for the present invention varies with kind, viscosity and so forth of aqueous solution to be mixed, it is usually 0.001–30 weight parts, preferably 0.01–20 weight parts, as polymer with respect to 100 weight parts of the aqueous solution.

The image-forming layer and the protective layer of the thermally processed image recording material of the present invention contain polymer latex as a binder. The term "polymer latex" used in the present invention means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, one in which polymer is micelle dispersed, one in which polymer chains of polymer molecules having a hydrophilic portion are dispersed in molecular state or the like. The polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have an average particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be latex of the so-called core/shell type, which is different from ordinary polymer latex of a uniform structure. In this case, use of different glass transition temperatures of the core and shell may be preferred.

Preferred range of the glass transition temperature (Tg) of the polymer latex preferably used as the binder in the present invention varies for the image-forming layer and the protective layer. As for polymer latex for the image-forming layer, the glass transition temperature is preferably −30–80° C., more preferably 0–40° C., for accelerating diffusion of photographic elements during the heat development and obtaining good photographic properties including high Dmax and low fog. The protective layer is brought into contact with various apparatuses, and therefore polymer latex used for it preferably has a glass transition temperature of 25–80° C. in view of film strength and prevention of adhesion failure.

The polymer latex used in the present invention preferably shows a minimum film forming temperature (MFT) of about 0–90° C., more preferably about 30–70° C. A film-forming aid may be added in order to control the minimum film forming temperature. The film-forming aid is also referred to as a transient plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Specific examples of the film-forming aid include the following compounds.

K-1: Benzyl alcohol

K-2: 2-Dimethylaminoethanol

K-3: 2,2,4-Trimethylpentanediol-1,3-monoisobutyrate

K-4: Diacetone alcohol

K-5: Ethylene glycol monobutyl ether

K-6: Diethylene glycol monobutyl ether acetate

K-7: Dibutyl phthalate

K-8: Diethylene glycol

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomers are polymerized, or copolymers in which two or more different kinds of monomers are polymerized. The polymers may have a number average molecular weight of 5,000 to 1,000,000, preferably from 10,000 to 100,000 Polymers having a too small molecular weight may unfavorably provide insufficient mechanical strength, and those having a too large molecular weight may unfavorably provide bad film forming property.

Examples of the polymer latex used as the binder of the image-forming layer and the protective layer in the present invention include methyl methacrylate/methyl acrylate copolymer latex, methyl acrylate/methyl methacrylate/styrene copolymer latex, methyl methacrylate/ethyl acrylate copolymer latex, methyl methacrylate/n-butyl acrylate copolymer latex, methyl methacrylate/tert-butyl methacrylate copolymer latex, methyl methacrylate/tert-butyl methacrylate/acrylic acid copolymer latex, vinyl acetate/methyl methacrylate/acrylic acid copolymer latex, methyl methacrylate/n-butyl acrylate/acrylonitrile copolymer latex, methyl methacrylate/ethyl acrylate/acrylamide copolymer latex, methyl acrylate/methyl methacrylate/acrylic acid copolymer latex, methyl acrylate/ethyl acrylate/acrylic acid copolymer latex, methyl methacrylate/n-butyl acrylate/acrylic acid copolymer latex, methyl acrylate/styrene/methyl methacrylate/acrylic acid copolymer latex, ethyl acrylate/styrene/methyl methacrylate/acrylic acid copolymer latex, methyl methacrylate/styrene/n-butyl acrylate/acrylic acid copolymer latex, ethyl methacrylate/methyl acrylate/acrylic acid copolymer latex, methyl acrylate/tert-butyl methacrylate/acrylic acid copolymer latex, methyl acrylate/methyl methacrylate/hydroxyethyl methacrylate copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, vinylidene chloride/ethyl acrylate/acrylonitrile/methacrylic acid copolymer latex and so forth. Such polymers are also commercially available and examples thereof include acrylic resins such as CEBIAN A-4635, 46583, 4601 (all produced by Dicel Kagaku Kogyo Co, Ltd), Nipol LX811, 814, 821, 820, 857 (all produced by Nippon Zeon Co., Ltd.), VONCORT R3340, R3360, R3370, 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX410, 430, 435, 438C (all produced by Nippon Zeon Co., Ltd.); polyvinylidene chloride resins such as L502, L513 (both produced by Asahi Chemical Industry Co., Ltd,) ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or, if desired, as a blend of two or more of them.

In the present invention, the binder of the image-forming layer is preferably styrene/butadiene type latex, acryl type latex or styrene/acryl type latex.

In the present invention, the image-forming layer preferably contains 50 weight % or more, more preferably 70 weight % or more, of the aforementioned polymer latex based on the total binder.

The total amount of the binder for the image-forming layer is preferably in the range of 0.2–30 g/m$^2$, more preferably 1.0–15 g/m$^2$.

The total amount of the binder for the protective layer is preferably in the range of 0.2–10.0 g/m$^2$, more preferably 0.5–5.0 g/m$^2$.

In the present invention, the image-forming layer and the protective layer each may be provided as two or more layers. When the image-forming layer consists of two or more layers, it is preferred that polymer latex should be used as a binder for all of the layers. The protective layer is a layer provided on the image-forming layer, and when it consists of two or more layers, it is preferred that polymer latex should be used for at least one layer, especially the outermost protective layer.

In the present invention, first polymer latex introduced with functional groups, and a crosslinking agent and/or second polymer latex having a functional group that can react with the first polymer latex, which are described in JP-A-2000-19678, paragraphs 0023–0041, can also be added to each layer.

Specific examples of the aforementioned functional groups include carboxyl group, hydroxyl group, isocyanate group, epoxy group, N-methylol group, oxazolinyl group, amino group, vinylsulfonyl group and so forth. Examples of the crosslinking agent include epoxy compounds, isocyanate compounds, blocked isocyanate compounds, methylolated compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), water dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

The thermally processed image recording material of the present invention contains (a) a silver salt of an organic acid. The silver salt of an organic acid that can be used in the present invention is a silver salt relatively stable against light, but forms a silver image when it is heated at 80° or higher in the presence of an exposed photocatalyst (e.g., a latent image of photosensitive silver halide) and a reducing agent. The silver salt of an organic acid may be any organic substance containing a source of reducible silver ion. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percentage of silver behenate with respect to silver salt of an organic acid to be used. As silver salts of an organic acid other than silver behenate contained in the silver salts or organic acid used for the present invention, the silver salts of an organic acid exemplified above can preferably be used.

Silver salts of an organic acid that can be preferably used in the present invention can be prepared by allowing a solution or suspension of an alkali metal salt (e.g., Na salts, K salts, Li salts) of the aforementioned organic acids to react with silver nitrate. As the preparation method, the method described in Japanese Patent Application No. 11-104187, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in Japanese Patent Application No. 11-203413 can be used.

In the present invention, a dispersing agent soluble in water can be added to the aqueous solution of silver nitrate and the solution of alkali metal salt of an organic acid or reaction mixture, when the silver salt of an organic acid is prepared. Type and amount of the dispersing agent used in this case are specifically mentioned in Japanese Patent Application No. 11-115457, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol for use in the present invention may be added at any time during the preparation of the organic acid silver salt, but the tertiary alcohol is preferably used by adding at the time of preparation of the organic acid alkali metal salt to dissolve the organic acid alkali metal salt. The tertiary alcohol for use in the present invention may be added in any amount of from 0.01–10 in terms of the weight ratio to water used as a solvent for the preparation of the silver salt of an organic acid, but preferably added in an amount of from 0.03–1 in terms of weight ratio to water.

Although shape and size of the organic acid silver salt that can be used for the present invention are not particularly limited, those mentioned in Japanese Patent Application No, 11-104187, paragraph 0024 can be preferably used. The shape of the organic acid silver salt can be determined from a transmission electron microscope image of organic silver salt dispersion. An example of the method for determining monodispesibility is a method comprising obtaining standard deviation of volume weight average diameter of the organic acid silver salts The percentage of a value obtained by dividing standard deviation by volume weight average diameter (variation coefficient) is preferably 80% or less, more preferably 50% or less, particularly preferably 30% or less. As for the measurement method, for example, the grain size can be determined by irradiating organic acid silver salt dispersed in a solution with a laser ray and determining an autocorrelation function for change of the fluctuation of the scattered light with time (volume weight average diameter). The average grain size determined by this method is preferably from 0.05–10.0 μm, more preferably from 0.1–5.0 μm, further preferably from 0.1–2.0 μm, as grains in solid grain dispersion.

The silver salt of an organic acid that can be used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method described in Japanese Patent Application No. 11-115457 can be used.

In the present invention, for obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in Japanese Patent Application No. 11-104187, paragraphs 0027–0038 can be used.

The grain size in solid fine grain dispersion of organic acid silver salt (volume weight average diameter) can be determined by irradiating organic acid silver salt dispersed in a dispersion with a laser ray and determining an autocorrelation function for change of the fluctuation of the scattered light with time (volume weight average diameter) or determined from transmission electron microscope image of organic silver salt dispersion. The average grain size determined by this method is preferably from 0.05–10.0 μm, more preferably from 0.1–5.0 μm, further preferably from 0.1–2.0 μm, as grains in solid grain dispersion.

The grain size distribution in the organic acid silver salt solid grain dispersion preferably corresponds to monodispersion. Specifically, the percentage (variation coefficient) of the value obtained by dividing standard deviation of volume weight average diameter by volume weight average diameter is preferably 80% or less, more preferably 50% or less, particularly preferably 30% or less.

The organic acid silver salt solid grain dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing aid should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of from 0.1–5 g/m$^2$, more preferably from 1–3 g/m$^2$, in terms of silver amount.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, which are not the aforementioned halide compound.

The metal ions selected from Ca, Mg, Zn and Ag, which are preferably used in the present invention, may be added any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The thermally processed image recording material of the present invention contains (c) a photosensitive silver halide. The photosensitive silver halide used for the present invention is not particularly limited as for the halogen composition, and silver chloride, silver chlorobromide, silver bromide, silver iodobromide, silver chloroiodobromide and so forth maybe used. As for the preparation of grains of the photosensitive silver halide emulsion, the grains can be prepared by the method described in JP-A-11-119374, paragraphs 0217–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halogen composition may have a uniform distribution in the grains, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on the surfaces of silver chloride or silver chlorobromide grains may also be preferably used.

As for the grain size distribution of the silver halide grains used in the present invention, the grains show monodispersion degree of 30% or less, preferably 1–20%, more preferably 5–15%. The monodispersion degree used herein is defined as a percentage (%) of a value obtained by dividing standard deviation of grain size by average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains used in the present invention preferably contain a metal of Group VII or Group VIII in the periodic table of elements or a complex of such a metal. The metal or the center metal of the complex of a metal of Group VII or Group VIII of the periodic table is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more kinds of complexes of the same or different metals may also be used in combination. The metal complex content is preferably from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures described in JP-A-7-225445 and so forth can be used. Types and addition methods of these heavy metals and complexes thereof are described in JP-A-11-119374, paragraphs 0227–0240.

The photosensitive silver halide grains may be desalted by washing methods with water known in the art, such as the noodle washing and flocculation. However, the grain may not be desalted in the present invention.

The photosensitive silver halide grains used in the present invention are preferably subjected to chemical sensitization. For the chemical sensitization, the method described in JP-A-11-119374, paragraphs 0242–0250 can preferably be used.

Silver halide emulsions used in the present invention may be added with thiosulfonic acid compounds by the method described in European Patent Publication (hereinafter referred to as EP-A) 293917.

As gelatin used with the photosensitive silver halide used in the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, modified gelatin such as acid-treated gelatin and phthalated gelatin can also be used.

In the thermally processed image recording material of the present invention, one kind of photosensitive silver halide emulsion may be used or two or more different emulsions (for example, those having different average grain sizes, different halogen compositions, different crystal habits or those subjected to chemical sensitization under different conditions) may be used in combination.

The amount of the photosensitive silver halide per mole of the silver salt of an organic acid is preferably from 0.01–0.5 mole, more preferably from 0.02–0.3 mole, still more preferably from 0.03–0.25 mole. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, and a method of preparing a silver salt of an organic acid with mixing a photosensitive silver halide obtained separately at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550–750 nm, there can be mentioned the compounds of formula (II) mentioned in JP-A-10-186572, and more specifically, dyes of II-6, II-7, II-14, II-15, II-18, II-23 and II-25 mentioned in the same can be exemplified as preferred dyes As dyes that spectrally sensitize in a wavelength range of 750–1400 nm, there can be mentioned the compounds of formula (I) mentioned in JP-A-11-119374, and more specifically, dyes of (25), (26), (30) (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified. These sensitizing dyes can be used each alone, or two or more of them can be used in combination.

These sensitizing dyes can be added by the method described in JP-A11-119374, paragraph 0106. However, the method is not particularly limited to this method.

While the amount of the sensitizing dye used in the present invention may be selected to be a desired amount depending on the performance including sensitivity and fog, it is preferably used in an amount of $10^{-6-1}$ mole, more preferably $10^{-4-10-1}$ mole, per mole of silver halide in the photosensitive layer.

In the present invention, a supersensitizer can be used in order to improve spectral sensitization efficiency. Examples of the supersensitizer used for the present invention include the compounds disclosed in ES-A-587338, U.S. Pat. Nos. 3,877,943 and 4,873,184, and compounds selected from heteroaromatic or aliphatic mercapto compounds, heteroaromatic disulfide compounds, stilbenes, hydrazines and triazines, and so forth.

Particularly preferred supersensitizers are heteroaromatic mercapto compounds and heteroaromatic disulfide compounds disclosed in JP-A-5-341432, the compounds represented by the formulas (I) and (II) mentioned in JP-A-4-182639, stilbene compounds represented by the formula (I) mentioned in JP-A10-111543 and the compounds represented by the formula (I) mentioned in JP-A-11-109547. Specifically, there can be mentioned the compounds of M-1 to M-24 mentioned in JP-A-5-341432, the compounds of d-1) to d-14) mentioned in JP-A-4-182639, the compounds of SS-01 to SS-07 mentioned in JP-A-10-111543 and the compounds of 31, 32, 37, 38, 41-45 and 51-53 mentioned in JP-A-11-109547.

These supersensitizers can be added to the emulsion layer preferably in an amount of $10^{-4}$-1 mole, more preferably in an amount of 0.001–0.3 mole, per mole of silver halide.

The thermally processed image recording material of the present invention preferably contains a nucleating agent. While type of the nucleating agent that can be used in the present invention is not particularly limited, examples of preferred nucleating agents include the hydrazine derivatives represented by the formula (H) mentioned in Japanese Patent Application No. 11-87297 (specifically, the hydrazine derivatives mentioned in Tables 1–4 of the same), and all of the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP-A-741320.

Particularly preferably used nucleating agents are the substituted alkene derivatives, substituted isoxazole derivatives and particular acetal compounds represented by the formulas (1) to (3) mentioned in Japanese Patent Application No. 11-87297, and more preferably, the cyclic compounds represented by the formula (A) or (B) mentioned in the same, specifically Compounds 1–72 mentioned in Chem. 8 to Chem. 12 of the same may be used. Two or more of these nucleating agents may be used in combination.

The nucleating agent may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the nucleating agent may be used by dispersing powder of the nucleating agent in a suitable solvent such as water using a ball mill, colloid mill, or by means of ultrasonic wave according to a known method for solid dispersion.

While the nucleating agent may be added to the image-forming layer or any layer on the image-forming layer side, it is preferably added to the image-forming layer or a layer adjacent thereto.

The amount of the nucleating agent is preferably $1\times10^{-6}$ mole to 1 mole, more preferably from $1\times10^{-5}$ mole to $5\times10^{-1}$ mole, most preferably from $2\times10^{-5}$ mole to $2\times10^{-1}$ mole, per mole of silver.

In addition to the aforementioned compounds, the compounds disclosed in U.S. Pat. Nos. 5,545,515, 5,635,339, 5,654,130, International Patent Publication WO97/34196 and U.S. Pat. No. 5,686,228, and the compounds disclosed in JP-A-11-119372, JP-A-11-133546, JP-A-11-119373, JP-A-11-109546, JP A-11-95365, JP-A-11-95366 and JP-A-11-149136 may also be used.

In the present invention, a contrast accelerator may be used in combination with the above-described nucleating agent for the formation or an ultrahigh contrast image. For example, amine compounds described in U.S. Pat. No. 5,545,505, specifically, AM-1 to AM-5; hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-9-297368, specifically, A-1 to A-42, B-1 to B-27 and C-1 to C-14 and so forth may be used.

Formic acid and formic acid salts serve as a strongly fogging substance in a thermally processed image recording material containing a non-photosensitive silver salt, a photosensitive silver halide and a binder. In the present invention, the thermally processed image recording material preferably contains formic acid or a formic acid salt on the side having the image-forming layer containing a photosensitive silver halide in an amount of 5 mmol or less, more preferably 1 mmol or less, per 1 mole of silver.

In the thermally processed image recording material the present invention, an acid formed by hydration of diphosphorus pentoxide or a salt thereof is preferably used together with the nucleating agent. Examples of the acid formed by hydration of diphosphorus pentoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the thermally processed image recording material) depending on the desired performance including sensitivity and fog. However, it can preferably be used in an amount of 0.1–500 $mg/m^2$, more preferably 0.5–100 $mg/m^2$.

The thermally processed image recording material of the present invention preferably contains (b) a reducing agent for the silver salt of an organic acid. The reducing agent for the silver salt of an organic acid may be any substance that reduces silver ion to metal silver, preferably such an organic substance. Conventional photographic developers such as phenidone, hydroquinone and catechol are useful, but a hindered phenol reducing agent is preferred. The reducing agent is preferably contained in an amount of from 5–50 mole %, more preferably from 10–40 mole %, per mole of silver on the side having the image-forming layer. The reducing agent may be added to any layer on the side having an image-forming layer. In the case of adding the reducing agent to a layer other than the image-forming layer, the reducing agent is preferably used in a slightly large amount of from 10–50 mole % per mole of silver. The reducing agent may also be a so-called precursor that is derived to effectively function only at the time of development.

For thermally processed image recording materials using a silver salt of an organic acid, reducing agents of a wide range are disclosed in, for example, JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328, EP-A-692732 and so forth. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2-bis(hydroxymethyl)propionyl-β-phenylhydrazine with ascorbic acid; combinations of polyhydroxybenzene with hydroxylamine, reductone and/or hydrazine such as a combination of hydroquinone with bis(ethoxyethyl) hydroxylamine, piperidinohexose reductone or formyl-4-methylphenylhydrazine, hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones; chromans such as 2,2-dimethyl-7-tert-butyl-6-hydroxychroman; 1,4-dihydropyridines such as 2,6-dimethoxy-3,5-dicarboethoxy-1,4-dihydropyridine; bisphenols such as bis(2-hydroxy-3-tert-butyl-5-methylphenyl)methane, 2,2-bis(4-hydroxy-3-methylphenyl) propane, 4,4-ethylidene-bis(2-tert-butyl-6-methylphenol), 1,1-bis(2-hydroxy-3,5-dimethylphenyl)-3,5,5-trimethylhexane and 2,2-bis-(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth. Particularly preferred reducing agents are bisphenols and chromanols.

In the present invention, the reducing agent may be added in any form of aqueous solution, solution in an organic solvent, powder, solid microparticle dispersion, emulsion dispersion or the like. The solid microparticle dispersion is performed by using a known pulverizing means (e.g., ball mill, vibrating ball mill, sand mill, colloid mill, jet mill, roller mill). At the time of solid microparticle dispersion, a dispersion aid may also be used.

In the present invention, the phenol derivatives represented by the formula (A) mentioned in Japanese Patent Application No. 11-73951 are preferably used as a development accelerator. The phenol derivatives represented by the formula (A) show strong development accelerating effect when they are used together with the aforementioned reducing agents. Specifically, A-1 to A-54 mentioned in the same are preferably used. The phenol derivatives represented by the formula (A) is used in an amount of preferably 0.01–100 mole %, more preferably 0.1–20 mole %, with respect to the reducing agents.

While the phenol derivatives represented by the formula (A) may be added to any layer on the image-forming layer side, i.e., the image-forming layer or any layers on the side of the image-forming layer, it is preferably added to a layer containing the reducing agent. The phenol derivatives represented by the formula (A) may be added in any form such as aqueous solution, solution in an organic solvent, powder, solid microparticle dispersion and emulsion dispersion. The solid microparticle dispersion is performed by using a known pulverizing means (e.g., ball mill, vibrating ball mill, sand mill, colloid mill, jet mill, roller mill). At the time of solid microparticle dispersion, a dispersion aid may also be used.

When an additive known as "toning agent" capable of improving images is added, the optical density increases in some cases. The toning agent may also be advantageous in forming a black silver image depending on the case. The toning agent is preferably contained in a layer on the side having the image-forming layer in an amount of from 0.1–50 mole %, more preferably from 0.5–20 mole %, per mole of silver. The toning agent may be a so-called precursor that is derived to effectively function only at the time of development.

For thermally processed image recording materials using a silver salt of an organic acid, toning agents of a wide range are disclosed in, for example, JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and4,510,236, British Patent No. 1,380,795, Belgian Patent No. 841910 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-di-methoxyphthalazine, 6-isobutylphthalazine, 6-tert-butylphthalazine, 5,7-dimethylphthalazine, 2,3-dihydrophthalazine) and metal salts thereof; combinations of phthalazine or a derivative thereof and a phthalic acid derivative (e.g., phthalic acid, 4-methylphthalic acid, 4-nitrophthalic acid, tetrachlorophthalic acid anhydride); quinazolinedione, benzoxazine and naphthoxazine derivatives; rhodium complexes which function not only as a toning agent but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione and 6-nitro-1,3-benzoxazin-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-di-mercapto-1H,4H-2,3a,5,6a-tetraazapentalene and so forth.

In the present invention, the phthalazine derivatives represented by the formula (F) mentioned in JP-A-2000-35631 are preferably used as the toning agent. Specifically, A-1 to A-10 mentioned in the same are preferably used.

In the present invention, the toning agent may be added in any form of solution, powder, solid microparticle dispersion or the like. The solid microparticle dispersion is performed by using known pulverization means (e.g., ball mill, vibrating ball mill, sand mill, colloid mill, jet mill, roller mill). At the time of solid microparticle dispersion, a dispersion aid may also be used.

The thermally processed image recording material of the present invention preferably has a film surface pH of 6.0 or less, more preferably 5.5 or less, before heat development. While it is not particularly limited as for the lower limit, it is normally around 3 or higher, For control ling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in Japanese Patent Application No. 11-87297, paragraph 0123.

The silver halide emulsion and/or the silver salt of an organic acid for use in the thermally processed image recording material of the present invention can be further prevented from the generation of additional fog or stabilized against the reduction in sensitivity during the stock storage, by an antifoggant, a stabilizer or a stabilizer precursor. Examples of suitable antifoggant, stabilizer and stabilizer precursor that can be used individually or in combination include the thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The thermally processed image recording material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637. The benzoic acid compound for use in the present invention may be added to any layer of the thermally processed image recording material, but it is preferably added to a layer on the image-forming layer side, more preferably a layer containing a silver salt of an organic acid. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution and microparticle dispersion, or may be added as a solution containing a mixture of the benzoic acid compound with other additives such as a sensitizing dye, reducing agent and toning agent. The benzoic acid compound may be added in any amount. However, the addition amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and 5,464,737.

The hydrophilic organic halides represented by the formula (P) mentioned in Japanese Patent Application No. 11-87297 can be preferably used as the antifoggant. Specifically, the compounds (P-1) to (P-118) mentioned in the same are preferably used.

The amount of the organic halides is preferably $1\times10^{-5}$ mole to 2 mole/mole Ag, more preferably $5\times10^{-5}$ mole to 1 mole/mole Ag, further preferably $1\times10^{-4}$ mole to $5\times10^{-1}$ mole/mole Ag, in terms of molar amount per mole of Ag (mole/mole Ag). The organic halides may be used each alone, or two or more of them may be used in combination.

Further, the salicylic acid derivatives represented by the formula (Z) mentioned in Japanese Patent Application No. 11-87297 can be preferably used as the antifoggant. Specifically, the compounds (A-1) to (A-60) mentioned in the same are preferably used. The amount of the salicylic acid represented by the formula (Z) is preferably $1\times10^{-5}$ mole to $5\times10^{-1}$ mole/mole Ag, more preferably $5\times10^{-5}$ mole to $1\times10^{-1}$ mole/mole Ag, further preferably $1\times10^{-4}$ mole to $5\times10^{-2}$ mole/mole Ag, in terms of molar amount per mole of Ag (mole/mole Ag). The salicylic acid derivatives may be used each alone, or two or more of them may be used in combination.

As antifoggants preferably used in the present invention, formalin scavengers are effective. Examples thereof include the compounds represented by the formula (S) and the exemplary compounds thereof (S-1) to (S-24) mentioned in Japanese Patent Application No. 11-23995.

The antifoggants used for the present invention may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, they may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, they may be used by dispersing powder of them in a suitable solvent such as water using a ball mill, colloid mill, sand grinder mill, MANTON GAULIN, microfluidizer, or by means of ultrasonic wave according to a known method for solid dispersion.

While the antifoggants used in the present invention may be added to any layer on the image-forming layer side, that is, the image-forming layer or other layers on that side, they are preferably added to the image-forming layer or a layer adjacent thereto. The image-forming layer is a layer containing a reducible silver salt (silver salt of an organic acid), preferably such a image-forming layer further containing a photosensitive silver halide.

The thermally processed image recording material of the present invention may contain a mercapto compound, disulfide compound or thione compound so as to control the development by inhibiting or accelerating the development or improve the storage stability before or after the development.

In the case of using a mercapto compound in the present invention, any structure may be used but those represented by Ar—SM or Ar—S—S—Ar are preferred, wherein M is hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone The heteroaromatic ring may have a substituent selected from, for example, the group consisting of a halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole) 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole and so forth. However, the present invention is not limited to these.

The amount of the mercapto compound is preferably from 0.0001–1.0 mole, more preferably from 0.001–0.3 mole, per mole of silver in the image-forming layer.

In the present invention, the image-forming layer is preferably formed by coating an aqueous coating solution and then drying the coating solution. The term "aqueous" as used herein means that water content of the solvent (dispersion medium) in the coating solution is 60 weight % or more.

The lubricant used in the present invention may be any compound which, when present on a surface of object, reduces the friction coefficient of the surface compared with that observed when the compound is absent, without particular limitation. The lubricant may be added to any layer so long as it can reduce friction coefficient. However, it is preferably added to outermost layers of the image-forming layer side and/or the side opposite thereto.

Examples of the lubricant that can be used in the present invention include the compounds described in JP-A-11-84573, paragraphs 0061–0064 and Japanese Patent Application No. 11-106881, paragraphs 0049–0062.

Preferred examples of the lubricant include Cellosol 524 (main component: carnauba wax), polysiloxanes, Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$ W-2: $C_{18}H_{37}$—O—$SO_3Na$ and so forth.

The amount of the lubricant used is 0.1–50 weight %, preferably 0.5–30 weight %, of the amount of binder in a layer to which the lubricant is added.

In the present invention, when such development apparatuses as disclosed in Japanese Patent Application Nos. 11-346561and11-106881 are used, in which a thermally processed image recording material Its transported in a pre-heating section by facing rollers, and the material is transported in a heat development section by driving force of rollers facing the image-forming layer side of the material, while the opposite back surface slides on a smooth surface, ratio of friction coefficients of the outermost surface of the image-forming layer side of the material and the outermost surface of the back layer is 1.5 or more at the heat development temperature. Although the ratio is not particularly limited for its upper limit, it is about 30 or less. The value of $\mu b$ included in the following equation is 1.0 or less, preferably 0.05–0.8.

The ratio can be obtained in accordance with the following equation.

Ratio of friction coefficients=coefficient of dynamic friction between roller material of heat development apparatus and surface of image-forming layer side ($\mu e$)/coefficient of dynamic friction between material of smooth surface member of heat development apparatus and back surface ($\mu b$)

In the present invention, the lubricity between the materials of the heat development apparatus and surfaces of outermost layers of the image-forming layer side and/or opposite back side at the heat development temperature can be controlled by adding a lubricant to the outermost layers and adjusting its addition amount.

It is preferred that undercoat layers containing a vinylidene chloride copolymer comprising 70 weight % or more of repetition units of vinylidene chloride monomers should be provided on the both surfaces of the support. Such vinylidene chloride copolymers are disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20 to page 3, right column, line 30, JP-A-2000-39684, paragraphs 0020–0037, and Japanese Patent Application No. 11-106881, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers as constituent repetition units, besides the repetition units of vinylidene chloride monomer. A polymer consists solely of vinylidene chloride monomers crystallizes, and therefore it becomes difficult to form a uniform film with such a polymer when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that undercoat layers containing the vinylidene chloride copolymer should have a thickness of 0.3 $\mu$m or more, preferably 0.3–4 $\mu$m, as a total thickness of the undercoat layers for one side.

The vinylidene chloride copolymer layer as an undercoat layer is preferably provided as a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer in such layers may be within the range of the present invention defined above.

Such an undercoat layer may contain a crosslinking agent, matting agent or the like, in addition to the vinylidene chloride copolymer.

The support may be coated with an undercoat layer comprising SBR, polyester, gelatin or the like as a binder, in addition to the vinylidene chloride copolymer layer, as required. The undercoat layer may have a multilayer structure, and may be provided on one side or both sides of the support. The undercoat layer generally has a thickness (per layer) of 0.01–5 $\mu$m, more preferably 0.05–1 $\mu$m.

For the thermally processed image recording material of the present invention, various kinds of supports can be used. Typical supports comprise polyester such as polyethylene terephthalate and polyethylene naphthalate, cellulose nitrate, cellulose ester, polyvinylacetal, syndiotactic polystyrene, polycarbonate, paper support of which both surfaces are coated with polyethylene or the like. Among these, biaxially stretched polyester, especially polyethylene terephthalate (PET), is preferred in view of strength, dimensional stability, chemical resistance and so forth. The support preferably has a thickness of 50–200 $\mu$m as a base thickness except for the undercoat layers.

Preferably used as the support of the thermally processed image recording material of the present invention is a polyester film, in particular polyethylene terephthalate film, subjected to a heat treatment in a temperature range of preferably 130–210° C., more preferably 130–185° C., in order to relax the internal distortion formed in the film during the biaxial stretching so that thermal shrinkage distortion occurring during the heat development could be eliminated. Such films are described in JP-A-10-48772, JP-A-10-10676, JP-A-10-10677, JP-A-11-65025 and JP-A-11-138648.

After such a heat treatment, the support preferably shows dimensional changes caused by heating at 120° C. for 30 seconds of −0.03% to +0.01% for the machine direction (MD) and 0 to 0.04% for the transverse direction (TD).

The thermally processed image recording material of the present invention can be subjected to an antistatic treatment using the conductive metal oxides and/or fluorinated surfactants disclosed in JP-A-11-84573, paragraphs 0040–0051 for the purposes of reducing adhesion of dusts, preventing generation of static marks, preventing transportation failure during the automatic transportation and so forth. As the conductive metal oxides, the conductive acicular tin oxide doped with antimony disclosed in U.S. Pat. No. 5,575,957 and JP-A-11-223901, paragraphs 0012–0020 and the fibrous tin oxide doped with antimony disclosed in JP-A-4-29134 can be preferably used.

The layer containing metal oxide should show a surface specific resistance (surface resistivity) of $10^{12}$ Ω or less, preferably $10^{11}$ Ω or less, in an atmosphere at 25° C. and 20% of relative humidity. Such a resistivity provides good antistatic property. Although the surface resistivity is not particularly limited as for the lower limit, it is usually about $10^{7}$ Ω or higher.

The thermally processed image recording material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

In the present invention, Beck smoothness can be easily determined according to Japanese Industrial Standard (JIS) P8119, "Test Method for Smoothness of Paper and Paperboard by Beck Test Device" and TAPPI standard Method T479.

Beck smoothness of the outermost surfaces of the image-forming layer side and the opposite side of the thermally processed image recording material can be controlled by suitably selecting particle size and amount of matting agent to be contained in the layers constituting the surfaces as described in JP-A-11-84573, paragraphs 0052–0059.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting surfactants from those described below and using them. As the surfactants used in the present invention, any of nonionic or ionic (anionic, cationic, betaine) surfactants can be used. Further, fluorinated surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid ester salts. Typical examples thereof are aliphatic acid salts, alkylbenzenesulfonates, alkylnaphthalenesulfonates, alkylsulfonates, α-olefinsulfonates, dialkylsulfosuccinates, α-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary amine salts and quaternary ammonium salts (tetraalkylammonium salts, trialkylbenzylammonium salts, alkylpyridinium salts, alkylimidazolium salts etc.) can be mentioned.

Examples of betaine type surfactants include carboxybetaine, sulfobetaine and so forth, and N-trialkyl-N-carboxymethylammoniumbetaine, N-trialkyl-N-sulfoalkylene-ammonium betaine and so forth can be mentioned.

These surfactants are described in Takao Karnyone, "Kaimen Kasseizai no Oyo (Applications of Surfactants", Saiwai Shobo, Sep. 1, 1980). In the present invention, amounts of the preferred surfactants are not particularly limited, and they can be used in an amount providing desired surface activating property. The coating amount of the fluorine-containing surfactants is preferably 0.01–250 mg per 1 $m^2$.

Specific examples of the surfactants are mentioned below, However, the surfactants are not limited to these (—$C_6H_4$— represents phenylene group in the following formulas).

WA-1: $C_{16}H_{33}(OCH_2CH_2)_{10}OH$

WA-2: $C_9H_{19}$—$C_6H_4$—$(OCH_2CH_2)_{12}OH$

WA-3: Sodium dodecylbenzenesulfonate

WA-4: Sodium tri(isopropyl)naphthalenesulfonate

WA-5: Sodium tri(isobutyl)naphthalenesulfonate

WA-6: Sodium dodecylsulfate

WA-7: α-Sulfasuccinic acid di(2-ethylhexyl) ester sodium salt

WA-8: $C_8H_{17}$—$C_6H_4$—$(CH_2CH_2O)_3(CH_2)_2SO_3K$

WA-10: Cetyltrimethylammonium chloride

WA-11: $C_{11}H_{23}CONHCH_2CH_2N^+(CH_3)_2$—$CH_2COO^-$

WA-12: $C_8F_{17}SO_2N(C_3H_7)(CH_2CH_2O)_{16}H$

WA-13: $C_8F_{17}SO_2N(C_3H_7)CH_2COOK$

WA-14: $C_8F_{17}SO_3K$

WA-15: $C_8F_{17}SO_2N(C_3H_7)(CH_2CH_2O)_4(CH_2)_4SO_3Na$

WA-16: $C_8F_{17}SO_2N(C_3H_7)(CH_2)_3OCH_2CH_2N^+(CH_3)_3$—$CH_3$—$C_6H_4$—$SO_3^-$

WA-17: $C_8F_{17}SO_2N(C_3H_7)CH_2CH_2CH_2N^+(CH_3)_2$—$CH_2COO^-$

In a preferred embodiment of the present invention, an intermediate layer may be provided as required in addition to the image-forming layer and the protective layer. For improving the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in JP-A-2000-2964, FIG.1 is particularly preferred.

Silver halide photographic materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As the drying method for the second drying zone and other drying zones after the second drying zone, there can be mentioned the air loop method where a support supported by rollers is blown by air jet from a U-shaped duct, the helix method (air floating method) where the support is helically wound around a cylindrical duct and dried during transportation thereof and so forth.

When the layers are formed by using coating solutions comprising polymer latex as a main component of binder, the flow of the coating solution cannot be stopped by rapid cooling. Therefore, the predrying may become insufficient only with the first drying zone. In such a case, if such a drying method as utilized for silver halide photographic materials is used, uneven flow or uneven drying may occur, and therefore serious defects are likely to occur on the coated surface.

A preferred drying method for the present invention is such a method as described in JP-A-2000-2964, where the drying is attained in a horizontal drying zone for a period corresponding to at least ¼ of the constant rate drying irrespective of the drying zone, i.e., the first or second drying zone. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone, the support may be transported at an angle within ±15° with respect to the horizontal direction of the coating machine, and it does not mean exactly horizontal transportation.

The drying air used for the constant rate drying preferably has a wind velocity of 1–30 m/second, more preferably 2–20 nm/second, at the coated liquid film surface. More preferably, a first drying zone consists of a low wind velocity region, in which region the wind velocity is 10 m/second or less, preferably 2–8 m/second, for a period of ½ or less of the constant rate drying period in the region, and a subsequent second drying zone consists of a high wind velocity region, in which region the wind velocity is 5–25 m/second or less, preferably 10–20 m/second, and whereby uneven drying can be prevented and productivity can be improved.

The constant rate drying used in the present invention means a drying process in which all entering calorie is consumed for evaporation of solvent at a constant liquid film temperature. Decreasing rate drying means a drying process where the drying rate is reduced by various factors (for example, diffusion of moisture in the material for moisture transfer becomes a rate-limiting factor, evaporation surface is recessed etc.) in an end period of the drying, and imparted calorie is also used for increase of liquid film temperature. When the constant rate drying is finished, the drying has sufficiently progressed so that the flowing could be stopped, and therefore such a drying method as used for silver halide photographic photosensitive materials may also be employable.

As for the drying condition for forming the image-forming layer and/or protective layer in the present invention, it is preferred that the liquid film surface temperature during the constant rate drying should be higher than minimum film forming temperature (MTF) of polymer latex to be used. In many cases, it is usually selected to be in the range of 25–40° C., because of limitations imposed by production facilities. Further, the dry bulb temperature during the decreasing rate drying is a preferably lower than Tg of the support to be used (in the case of PET, usually 80° C. or lower). The liquid film surface temperature referred to in this specification means a surface temperature of coated liquid film coated on a support, and the dry bulb temperature means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface Further, film strength also becomes weak and thus it becomes likely that there arise serious problems, for example, the film becomes liable to suffer from scratches during transportation in a light exposure apparatus or heat development apparatus.

On the other hand, if the support (base) is subjected to a temperature higher than its Tg, dimensional stability and resistance to curl tendency of the thermally processed image recording materials tend to be degraded.

The rolling up after the drying is preferably carried out under conditions of a temperature of 20–30° C. and a relative humidity of 45±20%. As for rolled shape, the material may be rolled so that the surface of the image-forming layer side may be toward the outside or inside of the roll according to a shape suitable for subsequent processing. Further, it is also preferred that, when the material is further processed in a rolled shaper the material should be rolled up into a shape of roll in which the sides are reversed compared with the original rolled shape during processing, in order to eliminate the curl generated while the material is in the original rolled shape. The thermally processed image recording material is preferably packaged under environmental conditions of a temperature in the range of 20–30° C. and relative humidity in the range of 20–65%. Humidity in the package is preferably controlled in the range of 20–55% in terms of relative humidity (measured at 25° C.)

In conventional coating solutions for photographic emulsions, which are viscous solutions containing silver halide and gelatin as a base, air bubbles are usually dissolved in the solutions and eliminated only by feeding the solutions by pressurization, and air bubbles are scarcely formed even when the solutions are placed under atmospheric pressure again for coating. However, as for the coating solution for the image-forming layer containing dispersion of silver salt of an organic acid, polymer latex and so forth preferably used in the present invention, only feeding of it by pressurization is likely to result in insufficient degassing. Therefore, it is preferably fed so that air/liquid interfaces could not be produced, while giving ultrasonic vibration to perform degassing.

In the present invention, the degassing of a coating solution is preferably performed by a method where the coating solution is degassed under reduced pressure before coating, and further the solution is maintained in a pressurized state at a pressure of 1.5 kg/cm$^2$ or more and continuously fed so that air/liquid interfaces could not be formed, while giving ultrasonic vibration to the solution. Specifically, the method disclosed in JP-B-55-6405 (from page 4, line 20 to page 7, line 11) is preferred. AS an apparatus for performing such degassing, the apparatus disclosed in Japanese Patent Application No. 10-290003, examples and FIG. 3 , can be preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5–3.0 V. Although a higher sound pressure is generally preferred, an unduly high sound pressure provides high temperature portions due to cavitation, which may causes fogging. While frequency of the ultrasonic wave is not particularly limited, it is usually 10 kHz or higher, preferably 20–200 kHz. The degassing under reduced pressure means a process where a coating solution is placed in a sealed tank (usually a tank in which the solution is prepared or stored) under reduced pressure to increase diameters of air bubbles in the coating solution so that degassing could be attained by buoyancy gained by the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg or higher. Time under the reduced pressure is 30 minutes or more, preferably 45 minutes or more, and its upper limit is not particularly defined.

In the present invention, the image-forming layer, protective layer for the image-forming layer, undercoat layer and back layer may contain a dye in order to prevent halation and so forth as disclosed in JP-A-11-84573, paragraphs 0204–0208 and Japanese Patent Application No. 11-106881, paragraphs 0240–0241.

Various dyes and pigments can be used for the image-forming layer of the thermally processed image recording material of the present invention for improvement of color tone and prevention of irradiation. While arbitrary dyes and pigments may be used for the image-forming layer, the compounds disclosed in JP-A-11-113374, paragraph 0297, for example, can be used. These dyes may be added in any form such as solution, emulsion, solid microparticle dispersion and macromolecule mordant mordanted with the dyes. Although the amount of these compounds is determined by the desired absorption, they are preferably used in an amount of $1\times10^{-6}$ g to 1 g per 1 $m^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used. There can also be used a method of reducing density obtained with a dye by thermal decoloration as disclosed in Belgian Patent No. 733,706, a method of reducing the density by decoloration utilizing light irradiation as disclosed in JP-A-54-17833 and so forth.

When the thermally processed image recording material of the present invention after heat development is used as a mask for the production of printing plates from PS plates, the thermally processed image recording material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, antihalation dye and filter dye are limited. Because the information is read by LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm as a bar code reader. That is, if Dmin (minimum density) around 670 nm is high, the information on the film cannot be correctly detected, and thus operation errors such as transportation failure, light exposure failure and so forth are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposure, any apparatus may be used so long as it is an exposure apparatus enabling light exposure with an exposure time of less than $10^{-7}$ second. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used.

The light exposure is performed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM).

In the present invention, it is preferred that this overlap coefficient is 0.2 or more.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel comprising two or more of laser heads is preferred for the cylinder external surface scanning method.

The thermally processed image recording material of the present invention shows low haze upon the light exposure, and therefore it is likely to generate interference fringes. As techniques for preventing such interference fringes, there are known a technique of obliquely irradiating a thermally processed image recording material with a laser light as disclosed in JP-A-5-113548, a technique of utilizing a multimode laser as disclosed in WO95/31754 and so forth, and these techniques are preferably used.

Although any method may be used for the heat development process of the image-forming method used for the present invention, the development is usually performed by heating a thermally processed image recording material exposed imagewise. As preferred embodiments of heat development apparatus to be used, there are heat development apparatuses in which a thermally processed image recording material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80–250° C., more preferably 100–140° C. The development time is preferably 1–180 seconds, more preferably 10–90 seconds.

As a method for preventing uneven development due to dimensional change of the thermally processed image recording material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

As for heat development of the thermally processed image-recording material of the present invention, such development apparatuses as disclosed in Japanese Patent Application Nos. 10-346561, 11-143058 and 11-196276 are preferably used, in which a thermally processed image recording material is transported in a pre-heating section by facing rollers, and the material is transported in a heat development section by driving force of rollers facing the image-forming layer side of the material, while the opposite back surface slides on a smooth surface.

Since the thermally processed image recording material of the present invention is subjected to a high temperature of 110° C. or higher during the heat development, a part of the components contained in the material or a part of decomposition products produced by the heat development are volatilized. It is known that these volatilized components exert various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or optimally control air flows in the heat development apparatus. These methods may be effectively used in combination.

WO95/30933, WO97/21150 and International Patent Publication in Japanese (Kohyo) No. 10-500496 disclose use of a filter cartridge containing binding absorption particles and having a first vent for introducing volatilized components and a second vent for discharging them in heating apparatuses for heating a film by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention.

Further, U.S. Pat. No. 4,518,845 and JP-B-3-54331 disclose structures comprising means for eliminating vapor from a film, pressing means for pressing the film to a heat-conductive member and means for heating the heat-conductive member. Further, WO98/27458 discloses elimination of components volatilized from a film and increasing fog from a surface of the film. These techniques are also preferably used for the present invention.

The present invention will be specifically explained with reference to the following examples. The materials, amounts, ratios, procedures and so forth shown in the following examples can be optionally changed so long as such change does not depart from the spirit of the present invention. Therefore, the scope of the present invention is not limited by the following examples.

<Synthesis Example 1 for synthesis of polymer as viscosity enhancer>

In an amount of 100 parts of N-morpholinoethylacrylamide and 1 part of 2,2'-azobis(2,4-dimethylvaleronitrile) were put into an ampoule, degassed by freezing, then sealed and allowed to polymerize at 50° C. for 8 hours to obtain Polymer (P-1).

<Synthesis Example 2 for synthesis of polymer as viscosity enhancer>

In an amount of 100 parts of N-(propylaminopropyl) acrylamide and 1 part of 2,2'-azobis(2,4-dimethylvaleronitrile) were put into an ampoule, degassed by freezing, then sealed and allowed to polymerize at 50° C. for 8 hours to obtain Polymer (P-2).

<Synthesis Example 3 for synthesis of polymer as viscosity enhancer>

In an amount of 100 parts of N-(4-methylpiperazinoethyl)methacrylamide and 1 part of 2,2'-azobis(2,4-dimethylvaleronitrile) were put into an ampoule, degassed by freezing, then sealed and allowed to polymerize at 50° C. for 8 hours to obtain Polymer (5-3).

<Synthesis Example 1 for synthesis of aqueous vinyl polymer as viscosity enhancer>

In an amount of 100 parts of 2-morpholinoethyl methacrylate (ester of 1-mole ethylene oxide adduct of morpholine and methacrylic acid) and 0.1 part of 2,2'-azobis(2,4-dimethylvaleronitrile) were put into an ampoule, degassed by freezing, then sealed and allowed to polymerize at 50° C. for 8 hours to obtain Aqueous vinyl polymer (P'-1).

<Synthesis Example 2 for synthesis of aqueous vinyl polymer as viscosity enhancer>

In an amount of 100 parts of 2-morpholinopropyl methacrylate (ester of 1-mole propylene oxide adduct of morpholine and methacrylic acid) and 0.1 part of 2,2'-azobis(2,4-dimethylvaleronitrile) were put into an ampoule, degassed by freezing, then sealed and allowed to polymerize at 50° C. for 8 hours to obtain Aqueous vinyl polymer (P'-2).

<Synthesis Example 3 for synthesis of aqueous vinyl polymer as viscosity enhancer>

In an amount of 100 parts of 2-(2-morpholinoethoxy)ethyl methacrylate (ester of 2-mole ethylene oxide adduct of morpholine and methacrylic acid) and 0.1 part of 2,2'-azobis (2,4-dimethylvaleronitrile) were put into an ampoule, degassed by freezing, then sealed and allowed to polymerize at 50° C. for 8 hours to obtain Aqueous vinyl polymer (P'-3).

EXAMPLE 1

<<Preparation of silver halide emulsion A>>

In 700 ml of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 40° C., 159 ml of an aqueous solution containing 18.6 g of silver nitrate and an aqueous solution containing 1 mol/l of potassiumbromide, $5\times10_{-6}$ mol/l of $(NH_4)_2RhCl_5(H_2O)$ and $2\times10^{-5}$ mol/l of $K_3IrCl_6$ were added by the control double jet method over 6 minutes and 30 seconds while pAg was maintained at 7.7. Then, 476 ml of an aqueous solution containing 55.5 g of silver nitrate and an aqueous solution containing 1 mol/l of potassium bromide and $2\times10^{-5}$ mol/l of $K_3IrCl_6$ were added by the control double jet method over 28 minutes and 30 seconds while pAg was maintained at 7.7. Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively. The grains obtained were cubic grains having a mean grain size of 0.08 $\mu$m, variation coefficient of 9% for projected area and [100] face ratio of The temperature of the silver halide grains obtained as described above was raised to 60° C., and the grains were added with sodium benzenethiosulfonate in an amount of 76 $\mu$mol per mole of silver. After 3 minutes, 71 $\mu$mol of triethylthiourea was further added, and the grains were ripened for 100 minutes, then added with $5\times10^{-4}$ mol/l of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) were added in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsion A.

tained by circulating cold water outside a double pipe. The addition position of the sodium behenate solution and the addition position of the aqueous silver nitrate solution were arranged symmetrically with respect to the stirring axis as the center, and the positions were controlled to be at heights for not contacting with the reaction mixture.

Sensitizing dye A

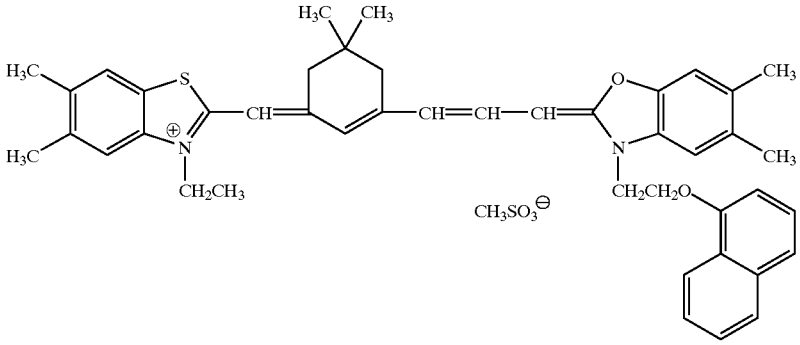

Compound A

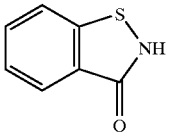

Compound B

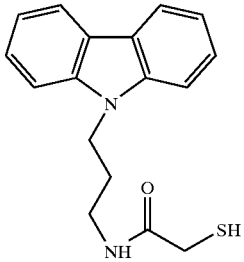

<<Preparation of silver behenate dispersion A>>

In an amount of 87.6 kg of behenic acid (Edenor C22-85R, trade name, produced by Henkel Co.), 423 l of distilled water, 49.2 l of aqueous solution of NaOH at 5 mol/l concentration and 120 l of tert-butanol were mixed and allowed to react at 75° C. for one hour with stirring to obtain a solution of sodium behenate. Separately, 206.2 l of an aqueous solution containing 40.4 kg of silver nitrate was prepared and kept at 10° C. A mixture of 635 l of distilled water and 30 l of tert-butanol contained in a reaction vessel kept at 30° C. was added with the whole volume of the aforementioned sodium behenaate solution and the whole volume of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and it was added in such a manner that only the aqueous solution of sodium behenate should be added for 9 minutes and 30 seconds after finishing the addition of the aqueous silver nitrate solution. During the addition, the temperature in the reaction vessel was kept at 30° C. and controlled so as not to be raised. The piping of the addition system for the sodium behenate solution was warmed by steam trace and the amount of steam was controlled such that the liquid temperature at the outlet orifice of the addition nozzle should be 75° C. The temperature of the piping of the addition system for the aqueous silver nitrate solution was main- After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 $\mu$S/cm. The solid content obtained as described above was stored as a wet cake without being dried.

When the shape of the obtained silver behenate grains was evaluated by an electron microscopic photography, the grains were scaly crystals having a mean diameter of projected areas of 0.52 $\mu$m, mean thickness of 0.14 $\mu$m and variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree; about 1700) and water to make the total amount 385 g, and the mixture was pre-dispersed by a homomixer. Then, the pre-dispersed stock dispersion was treated three times by using a dispersing machine (Microfluidizer-M-110S-EH; trade name, produced by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight mean diameter of 0.52 $\mu$m and variation coefficient of 15%. The measurement of the grain size was carried out by using Master Sizer X produced by Malvern Instruments Ltd. When the grains were evaluated by an electron microscopic photography, the ratio of the long side to the short side was 1.5, the grain thickness was 0.14 μm, and the mean aspect ratio (ratio of diameter as sphere of projected area of grain and grain thickness) was 5.1.

<<Preparation of solid microparticle dispersion of reducing agent: 1,1-bis(2-hydroxy-3,5-dimethylphenyl)-3,5,5-trimethylhexane>>

In an amount of 10 kg of 1,1-bis(2-hydroxy-3,5-dimethylphenyl)-3,5,5-trimethylhexane and 10 kg of 20 weight % aqueous solution of denatured polyvinyl alcohol (Poval MP203, produced by Kuraray Co. Ltd.) were added with 16 kg of water, and mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 3 hours and 30 minutes. Then, the slurry was added with 4 g of benzothiazolinone sodium salt and water so that the concentration of the reducing agent could become 25 weight % to obtain a solid microparticle dispersion of reducing agent. The reducing agent particles contained in the reducing agent dispersion obtained as described above had a median diameter of 0.44 μm, maximum particle diameter of 2.0 μm or less and variation coefficient of 19% for mean particle diameter. The obtained reducing agent dispersion was filtered through a polypropylene filter having a pore size of 3.0 μm to remove dusts and so forth, and stored.

<<Preparation of solid microparticle dispersion of organic polyhalogenated compound A>>

In an amount of 10 kg of Organic polyhalogenated compound A: tribromomethyl(4-(2,4,6-trimethylphenylsulfonyl)phenyl)sulf one, 10 kg of 20 weight aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 5 hours. Then, the slurry was added with water so that the concentration or Organic polyhalogenated compound A could become 25 weight % to obtain solid microparticle dispersion of Organic polyhalogenated compound A. The particles of the organic polyhalogenated compound contained in the dispersion obtained as described above had a median diameter of 0.36 μm, maximum particle diameter of 2.0 μm or less and variation coefficient of 18% for mean particle diameter. The obtained dispersion was filtered through a polypropylene filter having a pore size of 3.0 μm to remove dusts and so forth, and stored.

<<Preparation of solid microparticle dispersion of organic polyhalogenated compound B>>

In an amount of 5 kg of Organic polyhalogenated compound B: tribromomethylnaphthylsulfone, 2.5 kg of 20 weight % aqueous solution or denatured polyvinyl alcohol (Poval MP203, produced by Kuraray Co. Ltd.), 213 g of 20 weight % aqueous solution of sodium triisopropylnaphthalenesulfonate and 10 kg of water were mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 5 hours. Then, the slurry was added with 2.5 g of benzothiazolinone sodium salt and water so that the concentration of Organic polyhalogenated compound B could become 20 weight % to obtain solid microparticle dispersion of organic polyhalogenated compound B. The particles of the organic polyhalogenated compound contained in the dispersion obtained as described above had a median diameter of 0.38 μm, maximum particle diameter of 2.0 μm or less and variation coefficient of 20% for mean particle diameter. The obtained dispersion was filtered through a polypropylene filter having a pore size of 3.0 μm to remove dusts and so forth, and stored.

<<Preparation of solid microparticle dispersion of compound Z>>

In an amount of 3.5 kg of R-054 (Sanko Co., Ltd.) containing 85 weight % of Compound Z was added with 1 kg of MP polymer (ML-203, produced by Kuraray Co. Ltd.) and 15 kg of water, and mixed sufficiently to form slurry. The slurry was fed by a diaphragm pump to a sand mill of horizontal type (UVM-2, produced by Imex Co.) containing zirconia beads having a mean diameter of 0.5 mm, and dispersed for 7 hours. Then, the slurry was added with water so that the concentration or Compound Z could become 10 weight % to obtain solid microparticle dispersion of Compound Z. The particles of Compound Z contained in the dispersion obtained as described above had a median diameter of 0.45 μm, maximum particle diameter of 4.0 μm or less and variation coefficient of 17% for mean particle diameter. The obtained dispersion was filtered through a polypropylene filter having a pore size of 3.0 μm to remove dusts and so forth, and stored.

<<Preparation of dispersion of 6-isopropylphthalazine compound>>

| Preparation composition (amounts in 100 g of completed dispersion) and preparation method | | |
|---|---|---|
| (1) | Water | 87.9 g |
| (2) | Denatured polyvinyl alcohol (Poval MP203, manufactured by Kuraray Co., Ltd.) | 2.0 g |
| (3) | 20 weight % aqueous solution of sodium triisopropylnaphthalene-sulfonate | 3.0 g |
| (4) | 6-Isopropylphthalazine (70% aqueous solution) | 7.14 g |

Dispersion was prepared by following the process steps mentioned below.

1. (1) was added with (2) at room temperature with stirring so that (2) could not coagulate, and mixed by stirring for 10 minutes.
2. Then, the mixture was heated until the internal temperature reached 50° C., and stirred for 1 hour to attain uniform dissolution.
3. The internal temperature was lowered to 40° C. or lower, and the mixture was added with (3) and (4) and stirred for 30 minutes to obtain a transparent dispersion.
4. The obtained dispersion was filtered through a polypropylene filter having a pore size of 3.0 μm to remove dusts and so forth, and stored.

<<Preparation of solid microparticle dispersion of nucleating agent A>>

In an amount of 4 kg of Nucleating agent A was added with 1 kg of Poval PVA-217 (produced by Kuraray Co., Ltd.) and 36 kg of water, and mixed sufficiently to form slurry. The slurry was fed by a diaphragm pump to a sand mill of horizontal type (UVM-2, produced by Imex Co.)

containing zirconia beads having a mean diameter of 0.5 mm, and dispersed for 12 hours. Then, the slurry was added with 4 g of benzothiazolinone sodium salt and water so that the concentration of the nucleating agent could become 10 weight % to obtain solid microparticle dispersion of the nucleating agent. The particles of the nucleating agent contained in the dispersion obtained as described above had a median diameter of 0.34 μm, maximum particle diameter of 3.0 μm or less, and variation coefficient of 19% for the particle diameter. The obtained dispersion was filtered through a polypropylene filter having a pore size of 3.0 μm to remove dusts and so forth, and stored.

<<Preparation of coating solution for image-forming layer>>

Silver behenate dispersion A prepared above was added with the following binder, materials and Silver halide emulsion A in the indicated amounts per mole of silver in Silver behenate dispersion A, and added with water to prepare a coating solution for image-forming layer. After the completion, the solution was degassed under reduced pressure of −350 mmHg for 60 minutes. The coating solution had a polymer latex concentration of 10.3 weight % and showed pH of 7.7 at 25° C.

| | |
|---|---|
| Binder: LACSTAR 3307B (SBR latex, produced by Dai-Nippon Ink & Chemicals, Inc., glass transition temperature: 17° C.) | 397 g as solid |
| 1,1-Bis(2-hydroxy-3,5-dimethylphenyl)-3,5,5-trimethylhexane | 149 g as solid |
| Organic polyhalogenated compound A | 43.5 g as solid |
| Organic polyhalogenated compound B | 13.5 g as solid |
| Sodium ethylthiosulfonate | 0.30 g |
| Benzotriazole | 1.04 g |
| Polymer shown in Table 1 | 12.0 g |
| 6-Isopropylphthalazine | 12.8 g as solid |
| Sodium dihydrogenorthophosphate dihydrate | 0.37 g |
| Compound Z | 9.7 g as solid |
| Nucleating agent A | 0.03 mole as solid |
| Dye A (added as a mixture with low molecular weight gelatin having mean molecular weight of 15000) | Amount giving optical density of 0.3 at 783 nm (about 0.37 g) |
| Silver halide emulsion A | 0.06 mole as Ag |
| Compound C | 2.0 g |
| Compound A as preservative | 40 ppm in the coating solution (2.5 mg/m$^2$ as coated amount) |
| Methanol | 2 weight % as to total solvent amount in the coating solution |
| Ethanol | 1 weight % as to total solvent amount in the coating solution |

-continued

Compound Z

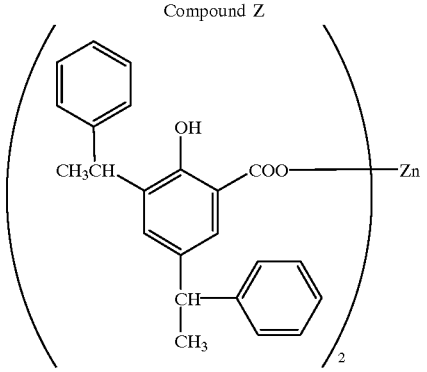

Dye A

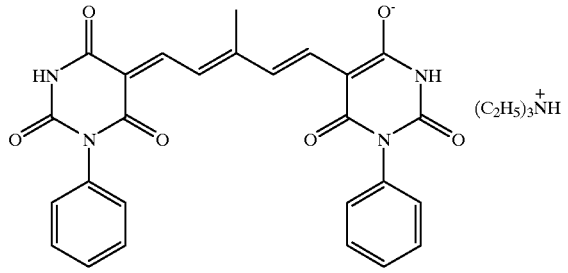

Compound C

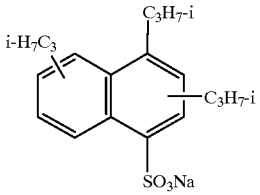

Nucleating agent A

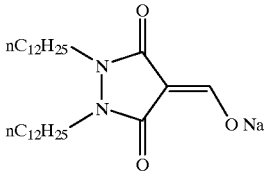

<<Preparation of coating solution for lower protective layer>>

In an amount of 203 g as solid content of methyl methacrylate/methyl acrylate 30/70 copolymer latex (containing 100 ppm of Compound A) was added with water, 1.62 g as solid content of Compound E as aqueous solution and 29.4 g as solid content of each polymer shown in Table 1 as aqueous solution and further added with water to form a coating solution (containing 2 weight % of methanol solvent).

After the completion, the solution was degassed under reduced pressure of −400 mmHg for 60 minutes. The coating solution had a polymer latex concentration of 11 weight % and showed pH of 5.5.

<<Preparation of coating solution for upper protective layer>>

In an amount of 140 g as solid content of methyl methacrylate/methyl acrylate=30/70 copolymer latex (containing 100 ppm of Compound A) was added with water, 6.30 g of 30 weight % solution of carnauba wax (Cellosol 524, silicone contents less than 5 ppm, Chukyo Yushi Co., Ltd.), 0.23 g of Compound C, 7.95 g of Compound F, 0.93 g of Compound E, 1.8 g of Compound G, 1.18 g as solid content of matting agent aqueous dispersion (polystyrene particles, mean particle diameter; 7 μm, variation coefficient of 8% for mean particle diameter, dispersing agent: 0.3 g of Compound E and 6.3 g of PVA-235 produced by Kuraray Co., Ltd. for 100 g of polystyrene particles) and 12.1 g as solid content of each polymer shown in Table 1 as an aqueous solution, and further added with water to form a coating solution (containing 1.5 weight % of methanol solvent). After the completion, the solution was degassed under reduced pressure of −400 mmHg for 60 minutes. The coating solution had a polymer latex concentration of 8 weight % and showed pH of 2.2.

Compound D

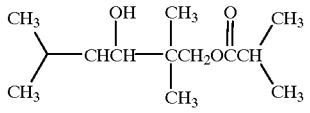

Compound E

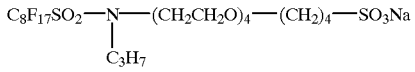

Compound F

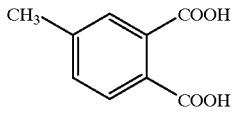

Compound G

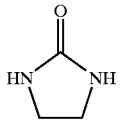

<<Preparation of polyethylene terephthalate (PET) support with back layers and undercoat layers>>

(1) Preparation of PET Support

Polyethylene terephthalate having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the film should have a thickness of 120 μm after thermal fixation.

The film was stretched along the longitudinal direction by 3.3 times using rollers of different peripheral speeds, and then stretched along the transverse direction by 4.5 times using a tenter. The temperatures used for these operations were 110° C. and 130° C., respectively. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 2.4 m, length of 3500 m, and thickness of 120 μm was obtained.

(2) Preparation of undercoat layers and back layers (2-1) First undercoat layer

The support was coated with a coating solution having the following composition in an amount of 6.2 ml/m$^2$, and dried at 125° C. for 30 seconds, 150° C. for 30 seconds, and 185° C. for 30 seconds.

| | |
|---|---|
| Latex A (Core/shell type latex comprising 90 weight % of core and 10 weight % of shell, core: vinylidene chloride/methyl acrylate/methyl methacrylate/acrylonitrile/acrylic acid = 93/3/3/0.9/0.1 (weight %), shell: vinylidene chloride/methyl acrylate/methyl methacrylate/acrylonitrile/acrylic acid = 88/3/3/3/3 (weight %), weight average molecular weight; 38000) | 280 g |
| KOH | 0.5 g |
| Polystyrene microparticles (mean particle diameter; 2 μm, variation coefficient of 7% for mean particle diameter) | 0.03 g |
| 2,4-Dichloro-6-hydroxy-s-triazine | 1.8 g |
| Distilled water | Amount giving total weight of 1000 g |

(2-2) Second undercoat layer

A coating solution having the following composition was coated on the first undercoat layer in an amount of 5.5 ml/m$^2$ and dried at 125° C. for 30 seconds, 150° C. for 30 seconds, and 170° C. for 30 seconds.

| | |
|---|---|
| Deionized gelatin ($Ca^{2+}$ content; 0.6 ppm, jelly strength; 230 g) | 10.0 g |
| Acetic acid (20% aqueous solution) | 10.0 g |
| Compound Bc-A | 0.04 g |
| Methylcellulose (2% aqueous solution) | 25.0 g |
| Polyethyleneoxy compound | 0.3 g |
| Distilled water | Amount giving total weight of 1000 g |

(2-3) First back layer

The surface of the support opposite to the surface coated with the undercoat layers was subjected to a corona discharge treatment of 0.375 kV.A.Minute/m$^2$, coated with a coating solution having the following composition in an amount of 13.8 ml/m$^2$, and dried at 125° C. for 30 seconds, 150° C. for 30 seconds, and 185° C. for 30 seconds,

| | |
|---|---|
| Julimer ET-410 (30% aqueous dispersion Nihon Junyaku Co., Ltd.) | 23.0 g |
| Alkali-treated gelatin (molecular weight; about 10000, $Ca^{2+}$ content; 30 ppm) | 4.44 g |
| Deionized gelatin ($Ca^{2+}$ content; 0.6 ppm) | 0.84 g |
| Compound Bc-A | 0.02 g |
| Dye Bc-A | Amount giving optical density of 1.3–1.4 at 783 nm, about 0.88 g |
| Polyoxyethylene phenyl ether | 1.7 g |
| Sumitex Resin M-3 (8% aqueous solution, water-soluble melamine compound, Sumitomo Chemical Co., Ltd.) | 15.0 g |
| FS-10D (aqueous dispersion of Sb-doped $SbO_2$ acicular grains, Ishihara Sangyo Kaisha, Ltd.) | 24.0 g |
| Polystyrene microparticles (mean diameter; 2.0 μm, variation coefficient of 7% for mean particle diameter) | 0.03 g |
| Distilled water | Amount giving total weight of 1000 g |

(2-4) Second back layer

A coating solution having the following composition was coated on the first back layer in an amount of 5.5 ml/m$^2$ and dried at 125° C. for 30 seconds, 150° C. for 30 seconds, and 170° C. for 30 seconds.

| | |
|---|---|
| Julimer ET-410 (30% aqueous dispersion Nihon Junyaku Co., Ltd.) | 57.5 g |
| Polyoxyethylene phenyl ether | 1.7 g |
| Sumitex Resin M-3 (8% aqueous solution, water-soluble melamine compound, Sumitomo Chemical Co., Ltd.) | 15.0 g |
| Cellosol 524 (30% aqueous solution, Chukyo Yushi Co., Ltd.) | 6.6 g |
| Distilled water | Amount giving total weight of 1000 g |

(2-5) Third back layer

The same coating solution as the first undercoat layer was coated on the second back layer in an amount of 6.2 ml/m$^2$ and dried at 125° C. for 30 seconds, 150° C. for 30 seconds, and 185° C. for 30 seconds.

(2-6) Fourth back layer

A coating solution having the following composition was coated on the third back layer in an amount of 13.8 ml/m$^2$ and dried at 125° C. for 30 seconds, 150° C. for 30 seconds, and 170° C. for 30 seconds.

| | |
|---|---|
| Latex (CHEMIPEARL S120, Mitsui Petrochemical Industries, Ltd.) | 77.22 g as solid |
| Compound Bc-B | 2.7 g |
| Compound Bc-C | 0.6 g |
| Compound Bc-D | 0.5 g |
| 2,4-Dichloro-6-hydroxy-s-triazine | 0.8 g |
| Polymethyl methacrylate (10% aqueous dispersion, mean particle diameter: 5.0 μm, variation coefficient of 7% for mean particle diameter) | 7.7 g |
| Distilled water | Amount giving total weight of 1000 g |

Dye Bc-A

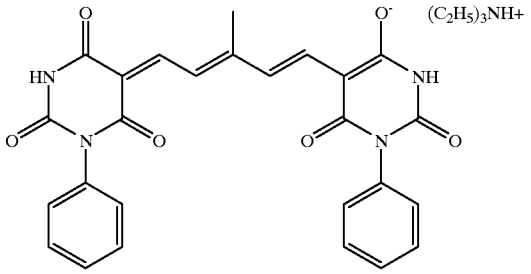

Compound Bc-A

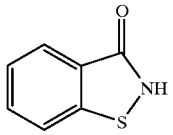

Compound Bc-B
$C_{18}H_{37}OSO_3Na$

-continued

Compound Bc-C
$C_8F_{17}SO_3Li$

Compound Bc-D

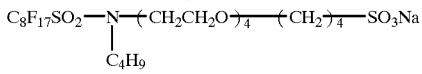

(3) Heat treatment during transportation (3-1) Heat treatment

The PET support with back layers and undercoat layers prepared as described above was introduced into a heat treatment zone having a total length of 200 m set at 160° C., and heat-treated by transporting it at a tension of 2 kg/cm$^2$ and a transportation speed of 20 m/minute.

(3-2) Post-heat treatment

Following the above heat treatment, the support was subjected to a post-heat treatment by passing it through a zone at 40° C. for 15 seconds, and rolled up. The rolling up tension for this operation was 10 kg/cm$^2$.

<<Preparation of thermally processed image recording materials>>

On the undercoat layers of the aforementioned PET support coated with the first and second undercoat layers, the aforementioned coating solution for image-forming layer was coated so that the coated silver amount could become 1.5 g/m$^2$ by the slide bead method disclosed in JP-A-2000-2964, FIG. 1 . On the image-forming layer, the aforementioned coating solution for lower protective layer and coating solution for upper protective layer were coated simultaneously with the coating solution for image-forming layer as stacked layers so that the coated solid content of the polymer latex in the lower protective layer could become 0.8 g/m$^2$ and the coated solid content of the polymer latex in the upper protective layer should become 1.0 g/m$^2$.

After the coating, the layers were dried in a first drying zone (low wind velocity drying region) at a dry-bulb temperature of 75° C., dew point of 22–25° C., wind velocity of 4–6 m/second at the support surface and liquid film surface temperature of 40° C., and in a second drying zone (high wind velocity drying region) at a dry-bulb temperature of 48–53° C., dew point of 5–10° C. and wind velocity of 20–25 m/second at the support surface. The drying was performed with the residence time in the first drying zone corresponding to ⅓ of the period of the constant ratio drying in this zone (20–25 seconds), and by transferring the material to the second drying zone. The first drying zone was a horizontal drying zone (the support was at an angle of 1.5–3° to the horizontal direction of the coating machine). The coating speed was 60 m/minute.

Shear viscosity of the coating solutions was measured at 40° C. by using an RFS fluid spectrometer produced by Rheometric Far East Co., Ltd.

As for polymer latex that generated film-forming failure only by the drying in the first drying zone, the coating solution was prepared by further adding Exemplary Compound K-3 as a film-forming aid in an amount of 10 weight % with respect to the solid content of the polymer latex.

The following evaluations were performed for the obtained samples.

<<Evaluation>>

(1) Generation of cracks of coated film (cracking)

Coated films of the obtained samples were observed by visual inspection to evaluate cracking condition of the coated films.

Evaluation score

5: No cracks were generated.

3: Cracks were partially generated.

1: Cracks were generated over the entire surface.

"4" indicates an intermediate level between "5" and "3", and "2" indicates an intermediate level between "3" and "1".

(2) Evaluation for adhesion between image-forming layer and protective layer

Adhesive tapes were adhered to surfaces of protective layers of the obtained samples and peeled at a constant speed. Degree of exfoliation of the protective layer or image-forming layer at that time was evaluated with 5 levels. For practical use, materials must show a score of "5" or "4".

5: No exfoliation

4: Exfoliation for ¼ of surface

3: Exfoliation for ⅔ of surface

2: Exfoliation for ¾ of surface

1: Exfoliation for entire surface (3) Evaluation of photographic property

The obtained samples were light-exposed by a xenon flash light of an emission time of $10^{-6}$ seconds through an interference filter having a peak at 780 nm and a continuous wedge, and developed by using the aforementioned heat development apparatus.

Sensitivity: A logarithmic value of exposure giving a density of 1.5 was obtained.

γ:γ value was obtained as incline of a line connecting a point of fog (fog density)+density of 0.3 and a point of fog+density of 0.3 in each characteristic curve.

Dmax: Dmax was obtained as a maximum density in each characteristic curve.

The obtained results are shown in Table 1, As clearly seen from the results shown in Table 1, the samples according to the present invention were markedly improved as for the generation of cracks in coated films and the adhesion. As for the photographic properties, all of the samples showed good performance.

TABLE 2

| Sample No. | Image-forming layer Polymer | Lower protective layer Polymer | Upper protective layer Polymer | Cracks in coated film | Adhesion in film before development |
|---|---|---|---|---|---|
| 21 | PVA-235 | PVA-235 | PVA-235 | 2 | 2 |
| 22 | PVA-235 | PVA-217 | PVA-217 | 2 | 3 |
| 23 | PVA-217 | PVA-217 | PVA-217 | 1 | 3 |
| 24 (Invention) | P-1 | P-1 | P-1 | 5 | 5 |
| 25 (Invention) | P-1 | PVA-235 | PVA-235 | 5 | 5 |
| 26 (Invention) | P-2 | P-2 | P-2 | 5 | 5 |
| 27 (Invention) | P-2 | PVA-235 | PVA-235 | 5 | 5 |
| 28 (Invention) | P-3 | P-3 | P-3 | 4 | 5 |
| 29 (Invention) | P-3 | PVA-235 | PVA-235 | 4 | 5 |
| 30 (Invention) | P'-1 | P'-1 | P'-1 | 5 | 5 |
| 31 (Invention) | P'-1 | PVA-235 | PVA-235 | 5 | 5 |
| 32 (Invention) | P'-2 | P'-2 | P'-2 | 5 | 5 |
| 33 (Invention) | P'-2 | PVA-235 | PVA-235 | 5 | 5 |
| 34 (Invention) | P'-3 | P'-3 | P'-3 | 5 | 5 |
| 35 (Invention) | P'-3 | PVA-235 | PVA-235 | 5 | 5 |

PVA-235: Polyvinyl alcohol produced by Kuraray Co., Ltd.
PVA-215: Polyvinyl alcohol produced by Kuraray Co., Ltd.

EXAMPLE 2

Samples were produced in the same manner as in Example 1, except that the binders of the lower protective layer and the upper protective layer used in Example I were changed to methyl methacrylate/methyl acrylate=43/57 copolymer latex and the binder of the image-forming layer was changed to HYDRAN AP 10 (Dai-Nippon Ink a Chemicals, Inc.).

The obtained thermally processed image recording materials were evaluated in the same manner as in Example 1. The results are shown in Table 2. As clearly seen from the results shown in Table 2, the samples according to the present invention were markedly improved as for the generation of cracks in coated films and the adhesion. As for the photographic properties, all of the samples showed good performance.

TABLE 1

| Sample No. | Image-forming layer Polymer | Lower protective layer Polymer | Upper protective layer Polymer | Cracks in coated film | Adhesion in film before development |
|---|---|---|---|---|---|
| 1 | PVA-235 | PVA-235 | PVA-235 | 3 | 3 |
| 2 | PVA-235 | PVA-217 | PVA-217 | 3 | 4 |
| 3 | PVA-217 | PVA-217 | PVA-217 | 1 | 4 |
| 4 (Invention) | P-1 | P-1 | P-1 | 5 | 5 |
| 5 (Invention) | P-1 | PVA-235 | PVA-235 | 5 | 5 |
| 6 (Invention) | P-2 | P-2 | P-2 | 5 | 5 |
| 7 (Invention) | P-2 | PVA-235 | PVA-235 | 5 | 5 |
| 8 (Invention) | P-3 | P-3 | P-3 | 4 | 5 |
| 9 (Invention) | P-3 | PVA-235 | PVA-235 | 4 | 5 |
| 10 (Invention) | P'-1 | P'-1 | P'-1 | 5 | 5 |
| 11 (Invention) | P'-1 | PVA-235 | PVA-235 | 5 | 5 |
| 12 (Invention) | P'-2 | P'-2 | P'-2 | 5 | 5 |
| 13 (Invention) | P'-2 | PVA-235 | PVA-235 | 5 | 5 |
| 14 (Invention) | P'-3 | P'-3 | P'-3 | 5 | 5 |
| 15 (Invention) | P'-3 | PVA-235 | PVA-235 | 5 | 5 |

PVA-235: Polyvinyl alcohol produced by Kuraray Co., Ltd.
PVA-215: Polyvinyl alcohol produced by Kuraray Co., Ltd.

The thermally processed image-recording material of the present invention shows suppressed film formation at the surface during drying by heating after coating of coating solution, and shows no "swelling" or "cracking" at the thermally processed image recording material surface and superior adhesion between images and support.

What is claimed is:

1. A thermally processed image recording material having, on a support, an image-forming layer containing at least (a) a silver salt of an organic acid, (b) a reducing agent and (c) a photosensitive silver halide and at least one protective layer provided on the image-forming layer and comprising polymer latex as binders of the image-forming layer and the protective layer, wherein at least one of the image-forming layer and the protective layer contains a viscosity enhancer that increases viscosity of its aqueous solution when the solution is heated and temperature of the solution exceeds a certain transition temperature, and the viscosity enhancer is a polymer selected from the group consisting of polymers containing a (meth)acrylamide derivative represented by the following formula (1) or (2) in an amount of 50 weight % or more as constituent units:

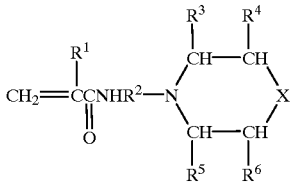

(in the formula (1), $R^1$ represents hydrogen atom or methyl group, $R^2$ represents an alkylene group having 1–6 carbon atoms, $R^3$ to $R^6$ each independently represent hydrogen atom or methyl group, and X represents —O—, —S—, —NH—, —N($R^7$)— where $R^7$ represents an alkyl group having 1–4 carbon atoms, —$CH_2$— or a direct bond),

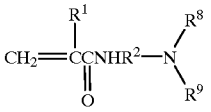

(in the formula (2), $R^1$ and $R^2$ have the same meanings as defined in the formula (1), and $R^8$ and $R^9$ each independently represent hydrogen atom or an alkyl group having 1–6 carbon atoms provided that the sum of the carbon numbers of $R^8$ and $R^9$ is 3 or more), and aqueous vinyl polymers containing a vinyl carboxylic acid esters of alkylene oxide adduct of active hydrogen compound having a nitrogen-containing ring in an amount of 50% or more as constituent units.

2. The thermally processed image recording material according to claim 1, wherein the (meth)acrylamide derivative is N-morpholinoethyl(meth)acrylamide or N-(4-methylpiperazinoethyl)(meth)acrylamide.

3. The thermally processed image recording material according to claim 1, wherein sum of carbon numbers of $R^8$ and $R^9$ in the formula (2) is 5–8.

4. The thermally processed image recording material according to claim 1, wherein the (meth)acrylamide derivative represented by the formula (2) is N-(N'-ethyl-N'-isopropylaminoethyl)(meth)acrylamide or N-(N'-ethyl-N'-dipropylaminoethyl)(meth)acrylamide.

5. The thermally processed image recording material according to claim 1, wherein the viscosity enhancer is a polymer containing the (meth)acrylamide derivative represented by the formula (1) or (2) in an amount of 70 weight % or more as constituent units.

6. The thermally processed image recording material according to claim 1, wherein the polymers containing the (meth)acrylamide derivative represented by the formula (1) or (2) has a weight average molecular weight of 1,000–5,000,000.

7. The thermally processed image recording material according to claim 6, wherein the polymers containing the (meth)acrylamide derivative represented by the formula (1) or (2) has a weight average molecular weight of 10,000–2,000,000.

8. The thermally processed image recording material according to claim 7, wherein the polymers containing the (meth)acrylamide derivative represented by the formula (1) or (2) has a weight average molecular weight of 10,000–1,000,000.

9. The thermally processed image recording material according to claim 1, wherein the nitrogen-containing ring of the aqueous vinyl polymer is piperidine ring or morpholine ring.

10. The thermally processed image recording material according to claim 1, wherein the alkylene oxide of the aqueous vinyl polymer is ethylene oxide and/or propylene oxide.

11. The thermally processed image recording material according to claim 1 wherein molar number of the added alkylene oxide in the aqueous vinyl polymer is 1–50 moles per mole of the active hydrogen compound.

12. The thermally processed image recording material according to claim 11, wherein the molar number of the added alkylene oxide in the aqueous vinyl polymer is 1–5 moles per mole of the active hydrogen compound.

13. The thermally processed image recording material according to claim 1, wherein the vinyl carboxylic acid in the aqueous vinyl polymer is (meth)acrylic acid.

14. The thermally processed image recording material according to claim 1, wherein the vinyl carboxylic acid ester in the aqueous vinyl polymer is an (meth)acrylic ester of 1–20 mole ethylene oxide and/or propylene oxide adduct of substituted or unsubstituted morpholine.

15. The thermally processed image recording material according to claim 1, wherein the aqueous vinyl polymer contains the vinyl carboxylic acid ester of the alkylene oxide adduct of active hydrogen compound having a nitrogen-containing ring in an amount of 70 weight % or more as constituent units.

16. The thermally processed image recording material according to claim 1, wherein the aqueous vinyl polymer has a molecular weight of 10,000–2,000,000.

17. The thermally processed image recording material according to claim 16, wherein the aqueous vinyl polymer has a molecular weight of 10,000–1,000,000.

18. The thermally processed image recording material according to claim 1, wherein the binder of the image-forming layer is styrene/butadiene latex, acryl latex or styrene/acryl latex.

19. The thermally processed image recording material according to claim 1, wherein the binder of the image-forming layer has a glass transition temperature of −30–80° C.

20. The thermally processed image recording material according to claim 1, wherein the binder of the protective layer has a glass transition temperature of 25–80° C.

* * * * *